US007945447B2

(12) United States Patent
Yoshida et al.

(10) Patent No.: US 7,945,447 B2
(45) Date of Patent: May 17, 2011

(54) SOUND CODING DEVICE AND SOUND CODING METHOD

(75) Inventors: Koji Yoshida, Kanagawa (JP); Michiyo Goto, Tokyo (JP)

(73) Assignee: Panasonic Corporation, Osaka (JP)

( * ) Notice: Subject to any disclaimer, the term of this patent is extended or adjusted under 35 U.S.C. 154(b) by 724 days.

(21) Appl. No.: 11/722,737

(22) PCT Filed: Dec. 26, 2005

(86) PCT No.: PCT/JP2005/023802

§ 371 (c)(1),
(2), (4) Date: Jun. 25, 2007

(87) PCT Pub. No.: WO2006/070751

PCT Pub. Date: Jul. 6, 2006

(65) Prior Publication Data

US 2008/0010072 A1 Jan. 10, 2008

(30) Foreign Application Priority Data

Dec. 27, 2004 (JP) ..... 2004-377965
Aug. 18, 2005 (JP) ..... 2005-237716

(51) Int. Cl.
*G10L 19/00* (2006.01)

(52) U.S. Cl. ..... 704/500; 704/501; 704/258; 704/201

(58) Field of Classification Search ..... 704/500, 704/501, 502, 200, 229, 230, 216–223, 503, 704/201, 258, 504; 381/20, 23; 708/322
See application file for complete search history.

(56) References Cited

U.S. PATENT DOCUMENTS 5,434,948 A 7/1995 Holt et al.
5,511,093 A 4/1996 Edler et al.
6,629,078 B1 9/2003 Grill et al.
(Continued)

FOREIGN PATENT DOCUMENTS

EP 1801783 A 6/2007
(Continued)

OTHER PUBLICATIONS

Liebchen, "Lossless Audio Coding using Adaptive Multichannel Prediction," Proceedings AES 113th Convention, [Online] Oct. 5, 2002, XP002466533, Los Angels, CA, Retrieved from the Internet: URL:http://www.nue.tu-berlin.de/publications/papers/aes113.pdf [retrieved on Jan. 29, 2008].
Ramprashad, "Stereophonic CELP Coding Using Cross Channel Prediction," Proceedings of the 2000 IEEE Workshop, pp. 136-138, 2000.
(Continued)

*Primary Examiner* — Huyen X. Vo
(74) *Attorney, Agent, or Firm* — Greenblum & Bernstein, P.L.C.

(57) ABSTRACT

A sound coding device having a monaural/stereo scalable structure and capable of efficiently coding stereo sound. even when the correlation between the channel signals of a stereo signal is small. In a core layer coding block of this device, a monaural signal generating section generates a monaural signal from first and second-channel sound signal, a monaural signal coding section codes the monaural signal, and a monaural signal decoding section greatest a monaural decoded signal from monaural signal coded data and outputs it to an expansion layer coding block. In the expansion layer coding block, a first-channel prediction signal synthesizing section synthesizes a first-channel prediction signal from the monaural decoded signal and a first-channel prediction filter digitizing parameter and a second-channel prediction signal synthesizing section synthesizes a second-channel prediction signal from the monaural decoded signal and second-channel prediction filter digitizing parameter.

16 Claims, 16 Drawing Sheets

U.S. PATENT DOCUMENTS

| | | | | |
|---|---|---|---|---|
| 7,181,019 | B2 * | 2/2007 | Breebaart et al. | 381/23 |
| 7,382,886 | B2 * | 6/2008 | Henn et al. | 381/23 |
| 2003/0191635 | A1 | 10/2003 | Minde et al. | |
| 2005/0160126 | A1 * | 7/2005 | Bruhn et al. | 708/322 |
| 2006/0133618 | A1 * | 6/2006 | Villemoes et al. | 381/20 |

FOREIGN PATENT DOCUMENTS

| | | |
|---|---|---|
| GB | 2279214 | 12/1994 |
| WO | 02/23529 | 3/2002 |

OTHER PUBLICATIONS

U.S. Appl. No. 11/573,100 to Goto et al., which was filed on Feb. 2, 2007.

U.S. Appl. No. 11/573,760 to Goto et al., which was filed on Feb. 15, 2007.

Baumgarte et al., "Binaural Cue Coding-Part I: Psychoacoustic Fundamentals and Design Principles," IEEE Trans. On Speech and Audio Processing, Nov. 2003, vol. 11, No. 6, pp. 509-519.

Kataoka et al., "G.729 o Kosei Yoso Toshite Mochiiru Scalable Kotaiiki Onsei Fugoka," The Transactions of the Institute of Electronics, Information and Communication Engineers, D-II, vol. J68-D-II, No. 3, pp. 379-387, Mar. 1, 2003 and partial English translation.

Kamamoto et al., "Channel-Kan Sokan o Mochiita Ta-Channel Shingo no Kagyoku Asshuku Fugoka," FIT2004 (Dai 3 Kai Forum on Information Technology) Koen Ronbunshu, M-016, Aug. 20, 2004, pp. 123-124.

Goto et al., "Onsei Tsushin'yo Stereo Onsei Fugoka Hoho no Kento," 2004 Nen The Institute of Electronics, Information and Communication Engineers Engineering Sciences Society Taikai Koen Ronbunshu, A-6-6, Sep. 8, 2004, p. 119 and English translation.

Yoshida et al., "Scalable Stereo Onsei Fugoka no channel-Kan Yosoku ni Kansuru Yobi Kento," 2005 Nen The Institute of Electronics, Information and Communication Engineers Sogo Taikai Koen Ronbunshu, D-14-1, Mar. 7, 2005, p. 118 and partial English translation.

Goto et al., "Onsei Tsushinyo Scalable Stereo Onsei Fugoka Hoho no Kento," FIT 2005 No. 4 Joho Kagaku Gijutsu forum, pp. 299-300 and partial English translation.

Christof Faller et al., "Binaural Cue Coding: A Novel and Efficient Representation of Spartial Audio", IEEE International Conference on Acoustics, Sppech, and Signal Processing, vol. 2, pp. 1841-1844, Dec. 31, 2002.

Goto et al., "Onsei Tsushinyo Scalable Stereo Onsei Fukugoka Hoho no Kento: A study of scalable stereo speech coding for speech communications," Forum on Information Technology Ippan Koen Runbunshu, XX, XX, No. G-17, Aug. 22, 2005, pp. 299-300, XP003011997.

Ramprashad, "Stereophonic celp coding using cross channel prediction," Speech Coding, 2000, Proceedings, 2000 IEEE Workshop on Sep. 17-20, 2000, Piscataway, NJ, USA, IEEE, Sep. 17, 2000, pp. 136-13, XP010520067.

* cited by examiner

| INTER-CHANNEL CORRELATION | PREDICTION GAIN A<br>s_ch2 → s_ch1<br>s_ch1 → s_ch2 | PREDICTION GAIN B<br>s_mono → s_ch1<br>s_mono → s_ch2 |
|---|---|---|
| HIGH | HIGH | HIGH |
| LOW | LOW | MEDIUM |

SOUND CODING DEVICE AND SOUND CODING METHOD

TECHNICAL FIELD

The present invention relates to a speech coding apparatus and a speech coding method. More particularly, the present invention relates to a speech coding apparatus and a speech coding method for stereo speech.

BACKGROUND ART

As broadband transmission in mobile communication and IP communication has become the norm and services in such communications have diversified, high sound quality of and higher-fidelity speech communication is demanded. For example, from now on, hands free speech communication in a video telephone service, speech communication in video conferencing, multi-point speech communication where a number of callers hold a conversation simultaneously at a number of different locations and speech communication capable of transmitting the sound environment of the surroundings without losing high-fidelity will be expected to be demanded. In this case, it is preferred to implement speech communication by stereo speech which has higher-fidelity than using a monaural signal, is capable of recognizing positions where a number of callers are talking. To implement speech communication using a stereo signal, stereo speech encoding is essential.

Further, to implement traffic control and multicast communication in speech data communication over an IP network, speech encoding employing a scalable configuration is preferred. A scalable configuration includes a configuration capable of decoding speech data even from partial coded data at the receiving side.

As a result, even when encoding and transmitting stereo speech, it is preferable to implement encoding employing a monaural-stereo scalable configuration where it is possible to select decoding a stereo signal and decoding a monaural signal using part of coded data at the receiving side.

Speech coding methods employing a monaural-stereo scalable configuration include, for example, predicting signals between channels (abbreviated appropriately as "ch") (predicting a second channel signal from a first channel signal or predicting the first channel signal from the second channel signal) using pitch prediction between channels, that is, performing encoding utilizing correlation between 2 channels (see Non-Patent Document 1).

Non-patent document 1:

Ramprashad, S. A., "Stereophonic CELP coding using cross channel prediction", Proc. IEEE Workshop on Speech Coding, pp. 136-138, September 2000.

DISCLOSURE OF INVENTION

Problems to be Solved by the Invention

However, when correlation between both channels is low, the speech coding method disclosed in Non-Patent Document 1 deteriorates prediction performance (prediction gain) between the channels and coding efficiency.

Therefore, an object of the present invention is to provide, in speech coding employing a monaural-stereo scalable configuration, a speech coding apparatus and a speech coding method capable of encoding stereo signals effectively when correlation between a plurality of channel signals of a stereo signal is low.

Means for Solving the Problem

The speech coding apparatus of the present invention employs a configuration including a first coding section that encodes a monaural signal at a core layer; and a second coding section that encodes a stereo signal at an extension layer, wherein: the first coding section comprises a generating section that takes a stereo signal including a first channel signal and a second channel signal as input signals and generates a monaural signal from the first channel signal and the second channel signal; and the second coding section comprises a synthesizing section that synthesizes a prediction signal of one of the first channel signal and the second channel signal based on a signal obtained from the monaural signal.

ADVANTAGEOUS EFFECT OF THE INVENTION

The present invention can encode stereo speech effectively when correlation between a plurality of channel signals of stereo speech signals is low.

BEST MODE FOR CARRYING OUT THE INVENTION

Speech coding employing a monaural-stereo scalable configuration according to the embodiments of the present invention will be described in detail with reference to the accompanying drawings.

Embodiment 1

Figure 1:
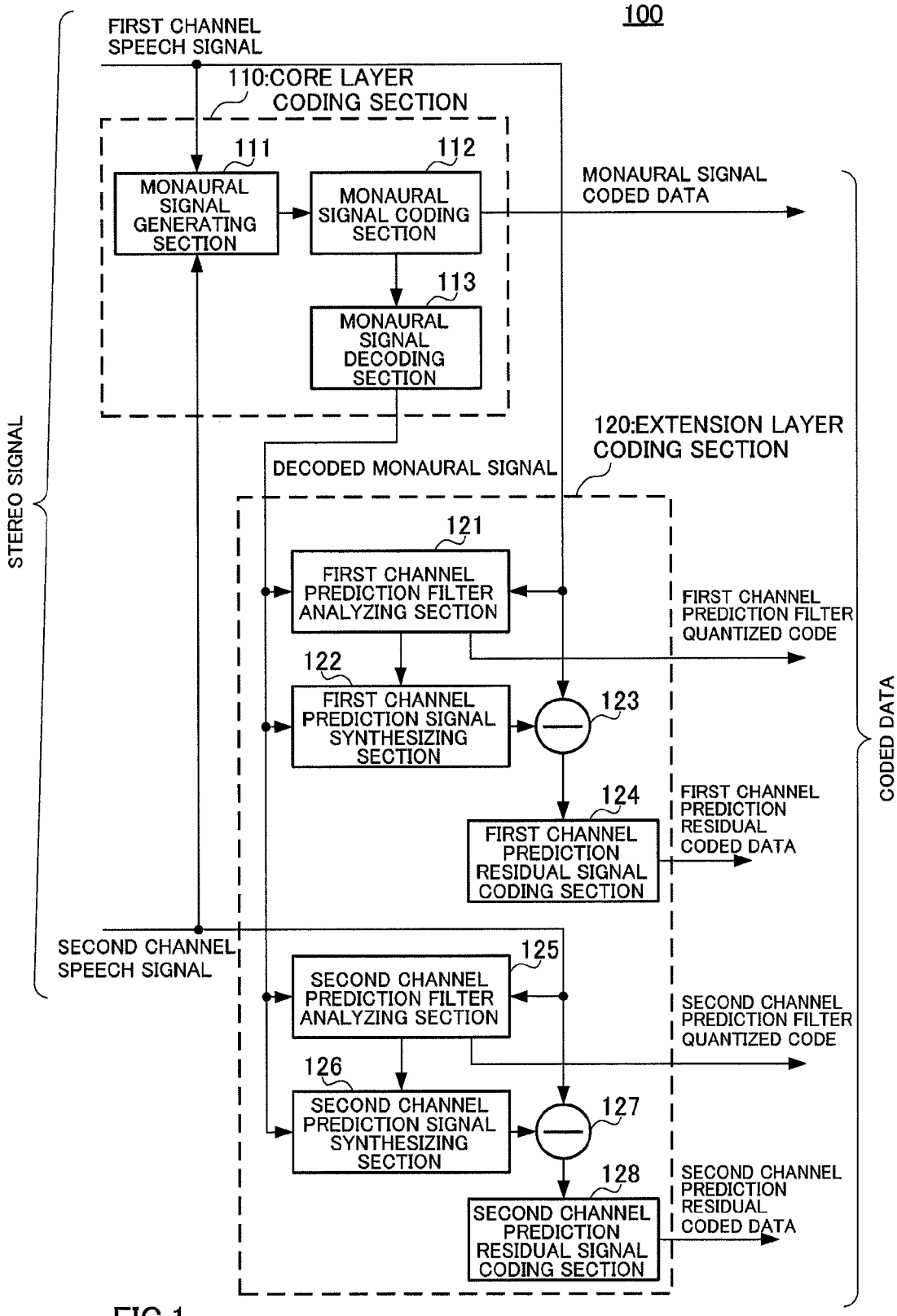
FIG. 1 is a block diagram showing a configuration of a speech coding apparatus according to Embodiment 1 of the present invention.

FIG. 1 shows a configuration of a speech coding apparatus according to the present embodiment. Speech coding apparatus 100 shown in FIG. 1 has core layer coding section 110 for monaural signals and extension layer coding section 120 for stereo signals. In the following description, a description is given assuming operation in frame units.

In core layer coding section 110, monaural signal generating section 111 generates and outputs a monaural signal s_mono(n) from an inputted first channel speech signal s_ch1($n$) and an inputted second channel speech signal s_ch2($n$) (where n=0 to NF−1, NF is frame length) in accordance with equation 1 to monaural signal coding section 112.

$$s_\mathrm{mono}(n)=(s_ch1(n)+s_ch2(n))/2 \quad \text{(Equation 1)}$$

Monaural signal coding section 112 encodes the monaural signal s_mono (n) and outputs coded data for the monaural signal, to monaural signal decoding section 113. Further, the monaural signal coded data is multiplexed with quantized code or coded data outputted from extension layer coding section 120, and transmitted to the speech decoding apparatus as coded data.

Monaural signal decoding section 113 generates and outputs a decoded monaural signal from coded data for the monaural signal, to extension layer coding section 120.

In extension layer coding section 120, first channel prediction filter analyzing section 121 obtains and quantizes first channel prediction filter parameters from the first channel speech signal s_ch1($n$) and the decoded monaural signal, and outputs first channel prediction filter quantized parameters to first channel prediction signal synthesizing section 122. A monaural signal s_mono(n) outputted from monaural signal generating section 111 may be inputted to first channel prediction filter analyzing section 121 in place of the decoded monaural signal. Further, first channel prediction filter analyzing section 121 outputs first channel prediction filter quantized code, that is, the first channel prediction filter quantized parameters subjected to encoding. This first channel prediction filter quantized code is multiplexed with other coded data and quantized code and transmitted to the speech decoding apparatus as coded data.

First channel prediction signal synthesizing section 122 synthesizes a first channel prediction signal from the decoded monaural signal and the first channel prediction filter quantized parameters and outputs the first channel prediction signal, to subtractor 123. First channel prediction signal synthesizing section 122 will be described in detail later.

Subtractor 123 obtains the difference between the first channel speech signal, that is, an input signal, and the first channel prediction signal, that is, a signal for a residual component (first channel prediction residual signal) of the first channel prediction signal with respect to the first channel input speech signal, and outputs the difference to first channel prediction residual signal coding section 124.

First channel prediction residual signal coding section 124 encodes the first channel prediction residual signal and outputs first channel prediction residual coded data. This first channel prediction residual coded data is multiplexed with other coded data or quantized code and transmitted to the speech decoding apparatus as coded data.

On the other hand, second channel prediction filter analyzing section 125 obtains and quantizes second channel prediction filter parameters from the second channel speech signal s_ch2($n$) and the decoded monaural signal, and outputs second channel prediction filter quantized parameters to second channel prediction signal synthesizing section 126. Further, second channel prediction filter analyzing section 125 outputs second channel prediction filter quantized code, that is, the second channel prediction filter quantized parameters subjected to encoding. This second channel prediction filter quantized code is multiplexed with other coded data and quantized code and transmitted to the speech decoding apparatus as coded data.

Second channel prediction signal synthesizing section 126 synthesizes a second channel prediction signal from the decoded monaural signal and the second channel prediction filter quantized parameters and outputs the second channel prediction signal to subtractor 127. Second channel prediction signal synthesizing section 126 will be described in detail later.

Subtractor 127 obtains the difference between the second channel speech signal, that is, the input signal, and the second channel prediction signal, that is, a signal for a residual component of the second channel prediction signal with respect to the second channel input speech signal (second channel prediction residual signal), and outputs the difference to second channel prediction residual signal coding section 128

Second channel prediction residual signal coding section 128 encodes the second channel prediction residual signal and outputs second channel prediction residual coded data. This second channel prediction residual coded data is multiplexed with other coded data or quantized code and transmitted to a speech decoding apparatus as coded data.

Figure 2:
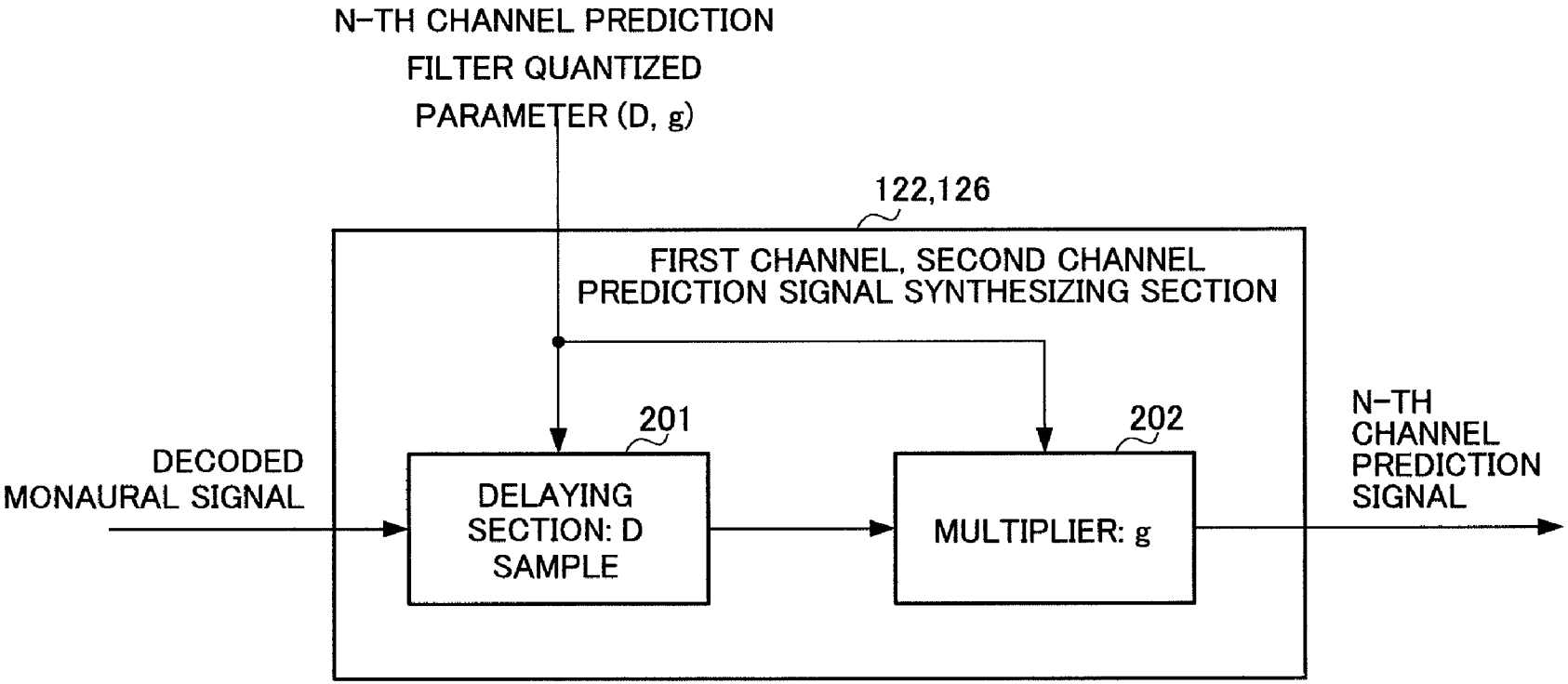
FIG. 2 is a block diagram showing a configuration of first channel and second channel prediction signal synthesizing sections according to Embodiment 1 of the present invention.

Next, first channel prediction signal synthesizing section 122 and second channel prediction signal synthesizing section 126 will be described in detail. The configurations of first channel prediction signal synthesizing section 122 and second channel prediction signal synthesizing section 126 is as shown in FIG. 2 <configuration example 1> and FIG. 3 <configuration example 2>. In the configuration examples 1 and 2, prediction signals of each channel obtained from the monaural signal are synthesized based on correlation between the monaural signal, that is, a sum signal of the first channel input signal and the second channel input signal, and channel signals by using delay differences (D samples) and amplitude ratio (g) of channel signals for the monaural signal as prediction filter quantizing parameters.

Configuration Example 1

In configuration example 1, as shown in FIG. 2, first channel prediction signal synthesizing section 122 and second channel prediction signal synthesizing section 126 have delaying section 201 and multiplier 202, and synthesizes prediction signals sp_ch(n) of each channel from the decoded monaural signal sd_mono(n) using prediction represented by equation 2.

[2]

$$\text{sp_}ch(n)=g\cdot\text{sd_mono}(n-D) \quad \text{(Equation 2)}$$

Configuration Example 2

Figure 3:
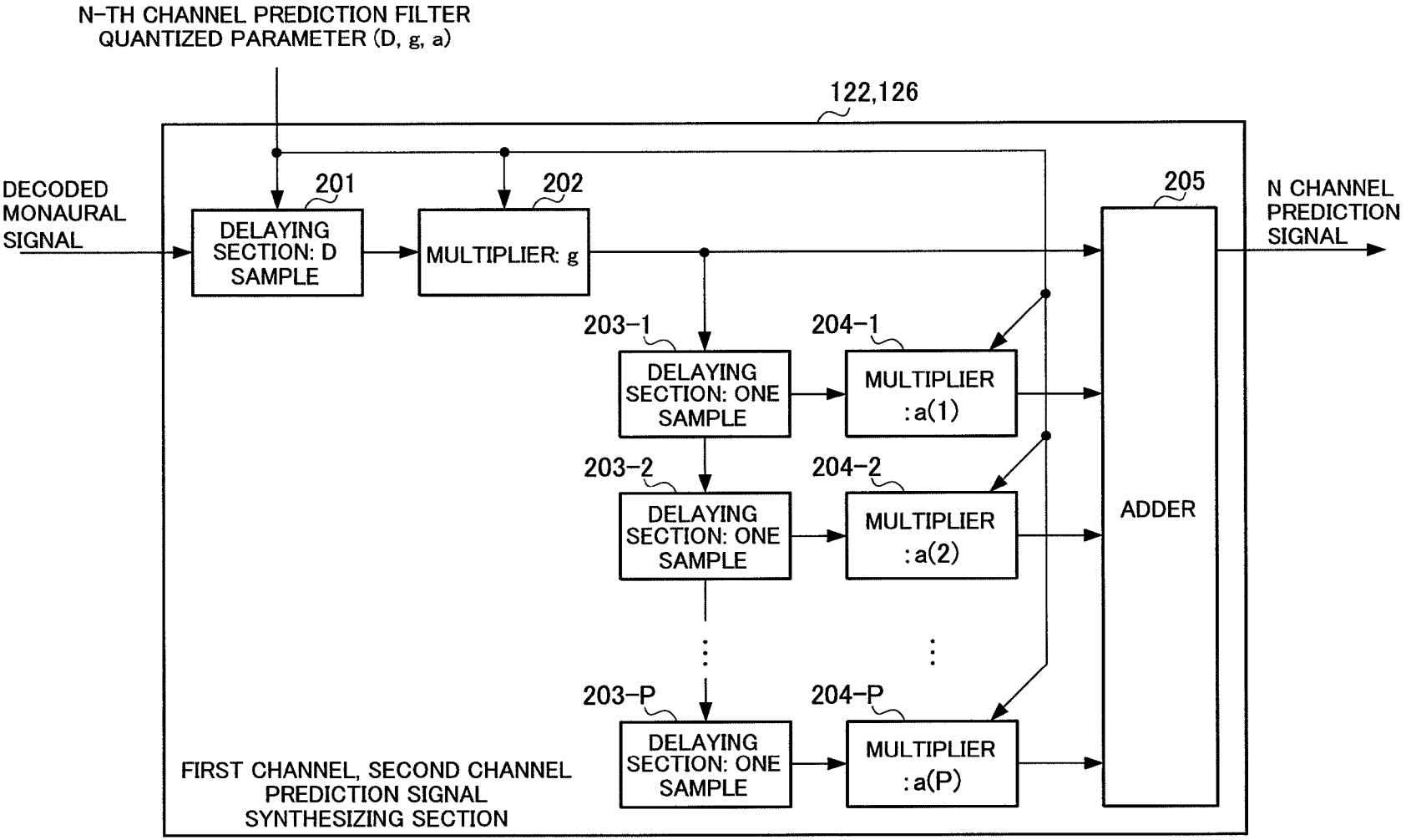
FIG. 3 is a block diagram showing a configuration of first channel and second channel prediction signal synthesizing sections according to Embodiment 1 of the present invention.

Configuration example 2, as shown in FIG. 3, further provides delaying sections 203-1 to P, multipliers 203-1 to P and adder 205 in the configuration shown in FIG. 2. In configuration example 2 a prediction signal sp_ch(n) of each channel is synthesized from the decoded monaural signal sd_mono(n) by using prediction coefficient series {a(0), a(1), a(2), . . . , a(P)} (where P is an order of prediction, and a(0)=1.0) as prediction filter quantized parameters in addition to delay differences (D samples) and amplitude ratio (g) of each channel for the monaural signal, and by using prediction represented by equation 3.

[3]

$$\text{sp_ch}(n)=\sum_{k=0}^{P}\{g\cdot a(k)\cdot\text{sd_mono}(n-D-k)\} \quad \text{(Equation 3)}$$

In contrast to this, first channel prediction filter analyzing section 121 and second channel prediction filter analyzing section 125 calculate distortion Dist represented by equation 4, that is, a distortion between input speech signals s_ch(n) (n=0 to NF−1) of each channel and prediction signals sp_ch (n) of each channel predicted in accordance with equations 2 or 3, find prediction filter parameters that minimize the distortion Dist, and output prediction filter quantized parameters obtained by quantizing the filter parameters to first channel prediction signal synthesizing section 122 and second channel prediction signal synthesizing section 126 employing the above configuration. Further, first channel prediction filter analyzing section 121 and second channel prediction filter analyzing section 125 output prediction filter quantized code obtained by encoding the prediction filter quantized parameters.

[4]

$$Dist=\sum_{n=0}^{NF-1}\{\text{s_ch}(n)-\text{sp_ch}(n)\}^2 \quad \text{(Equation 4)}$$

In configuration example 1, first channel prediction filter analyzing section 121 and second channel prediction filter analyzing section 125 may obtain delay differences D and average amplitude ratio g in frame units as prediction filter parameters that maximize correlation between the decoded monaural signal and the input speech signal of each channel.

Figure 4:
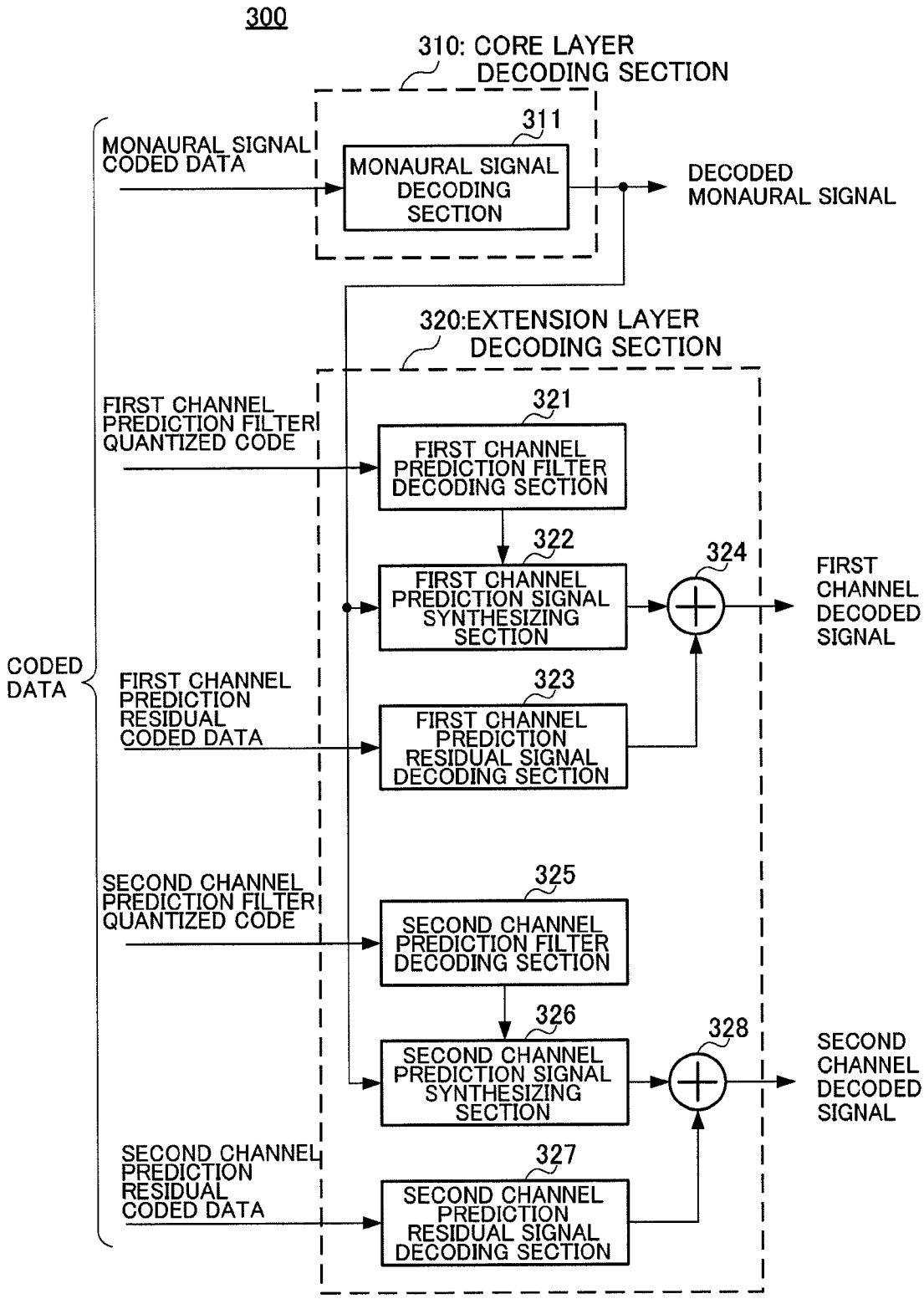
FIG. 4 is a block diagram showing a configuration of the speech decoding apparatus according to Embodiment 1 of the present invention.

The speech decoding apparatus according to the present embodiment will be described. FIG. 4 shows a configuration of the speech decoding apparatus according to the present embodiment. Speech decoding apparatus 300 has core layer decoding section 310 for the monaural signal and extension layer decoding section 320 for the stereo signal.

Monaural signal decoding section 311 decodes coded data for the input monaural signal, outputs the decoded monaural signal to extension layer decoding section 320 and outputs the decoded monaural signal as the actual output.

First channel prediction filter decoding section 321 decodes inputted first channel prediction filter quantized code and outputs first channel prediction filter quantized parameters to first channel prediction signal synthesizing section 322.

First channel prediction signal synthesizing section 322 employs the same configuration as first channel prediction signal synthesizing section 122 of speech coding apparatus 100, predicts the first channel speech signal from the decoded monaural signal and first channel prediction filter quantized parameters and outputs the first channel prediction speech signal to adder 324.

First channel prediction residual signal decoding section 323 decodes inputted first channel prediction residual coded data and outputs a first channel prediction residual signal to adder 324.

Adder 324 adds first channel prediction speech signal and first channel prediction residual signal and obtains and outputs a first channel decoded signal as the actual output.

On the other hand, second channel prediction filter decoding section 325 decodes inputted second channel prediction filter quantized code and outputs second channel prediction filter quantized parameters to second channel prediction signal synthesizing section 326.

Second channel prediction signal synthesizing section 326 employs the same configuration as second channel prediction signal synthesizing section 126 of speech coding apparatus 100, predicts the second channel speech signal from the decoded monaural signal and second channel prediction filter quantized parameters and outputs the second channel prediction speech signal to adder 328.

Second channel prediction residual signal decoding section 327 decodes inputted second channel prediction residual coded data and outputs a second channel prediction residual signal to adder 328.

Adder 328 adds the second channel prediction speech signal and second channel prediction residual signal and obtains and outputs a second channel decoded signal as the actual output.

Speech decoding apparatus 300 employing the above configuration, in a monaural-stereo scalable configuration, outputs a decoded signal obtained from coded data of the monaural signal alone as a decoded monaural signal when to output monaural speech, and decodes and outputs the first channel decoded signal and the second channel decoded signal using all received coded data and quantized code, when to output stereo speech.

Figures 5, 6:
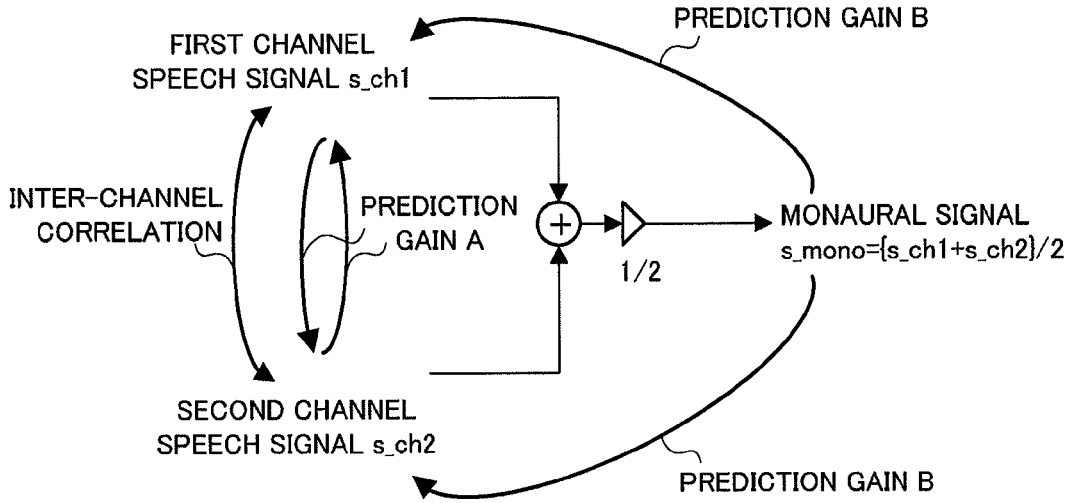
FIG. 5 is a view illustrating the operation of the speech coding apparatus according to Embodiment 1 of the present invention.
FIG. 6 is a view illustrating the operation of the speech coding apparatus according to Embodiment 1 of the present invention.

Here, as shown in FIG. 5, a monaural signal according to the present embodiment is obtained by adding the first channel speech signal s_ch1 and the second channel speech signal s_ch2 and is an intermediate signal including signal components of both channels. As a result, even when inter-channel correlation between the first channel speech signal and the second channel speech signal is low, correlation between the first channel speech signal and the monaural signal and correlation between the second channel speech signal and the monaural signal are expected to be higher than inter-channel correlation. Therefore, the prediction gain in the case of predicting the first channel speech signal from the monaural signal and the prediction gain in the case of predicting the second channel speech signal from the monaural signal (FIG. 5: prediction gain B) are likely to be larger than the gain in the case of predicting the second channel speech signal from the first channel speech signal and the prediction gain in the case of predicting the first channel speech signal from the second speech channel signal (FIG. 5: prediction gain A).

This relationship is shown in FIG. 6. Namely, when inter-channel correlation between the first channel speech signal and the second channel speech signal is sufficiently high, prediction gain A and prediction gain B having similar and sufficiently large values can be obtained. However, when inter-channel correlation between the first channel speech signal and the second channel speech signal is low, it is expected that prediction gain A abruptly falls compared with when inter-channel correlation is sufficiently high and that, in contrast to this, the degree of decline of prediction gain B is less than prediction gain A and has a larger value than prediction gain A.

According to the present embodiment, signals of each channel are predicted and synthesized from an monaural signal having signal components of both the first channel speech signal and the second channel speech signal, so that it is possible to synthesize signals having a larger prediction gain than the prior art for a plurality of signals having low inter-channel correlation. As a result, it is possible to achieve equivalent sound quality using encoding at a lower bit rate, and achieve higher quality speech at equivalent bit rates. According to this embodiment, it is possible to improve coding efficiency.

Embodiment 2

Figure 7:
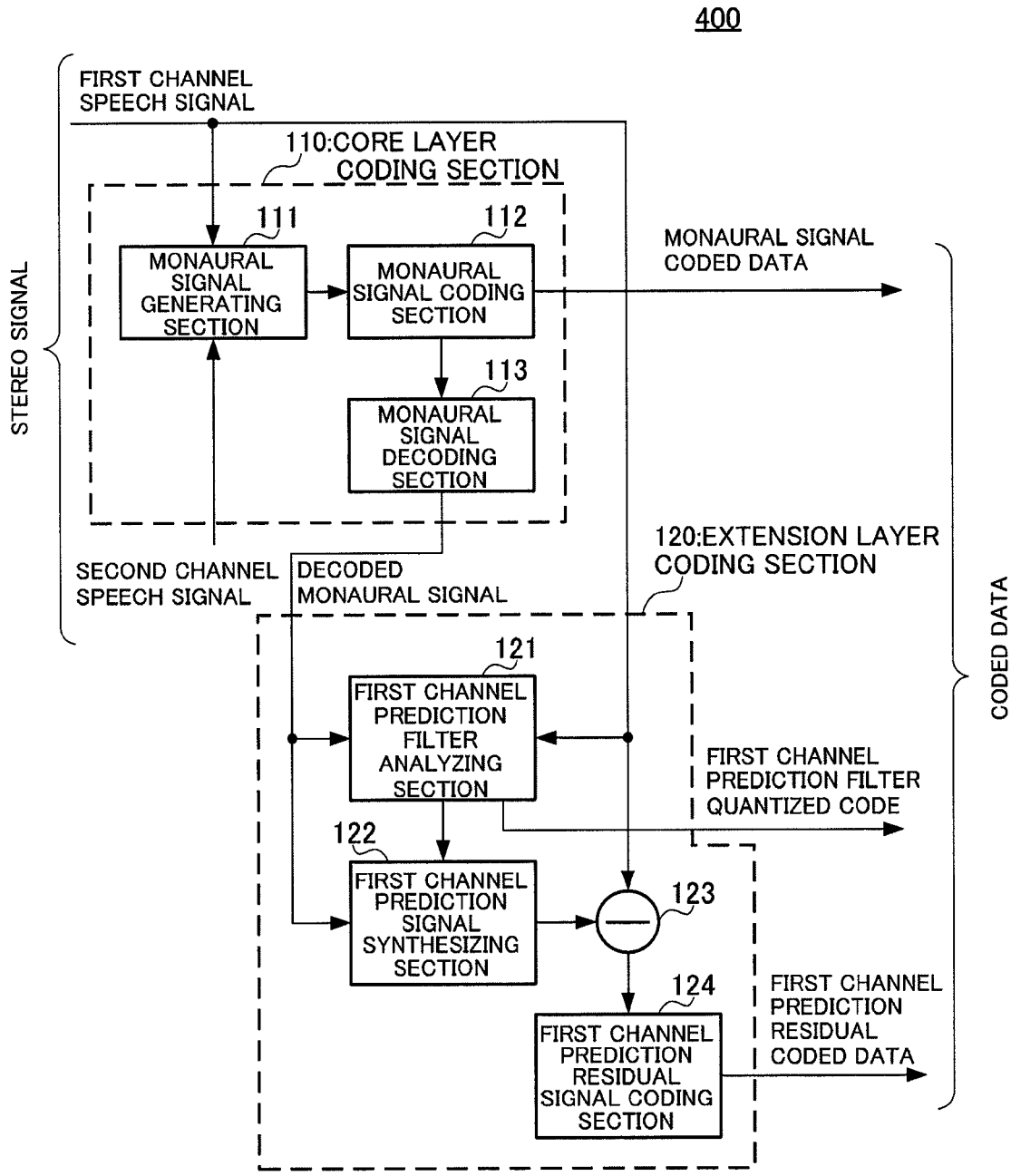
FIG. 7 is a block diagram showing a configuration of a speech coding apparatus according to Embodiment 2 of the present invention.

FIG. 7 shows a configuration of speech coding apparatus 400 according to the present embodiment. As shown in FIG. 7, speech coding apparatus 400 employs a configuration that removes second channel prediction filter analyzing section 125, second channel prediction signal synthesizing section 126, subtractor 127 and second channel prediction residual signal coding section 128 from the configuration shown in FIG. 1 (Embodiment 1). Namely, speech coding apparatus 400 synthesizes a prediction signal of the first channel alone out of the first channel and second channel, and transmits only coded data for the monaural signal, first channel prediction filter quantized code and first channel prediction residual coded data to the speech decoding apparatus.

Figure 8:
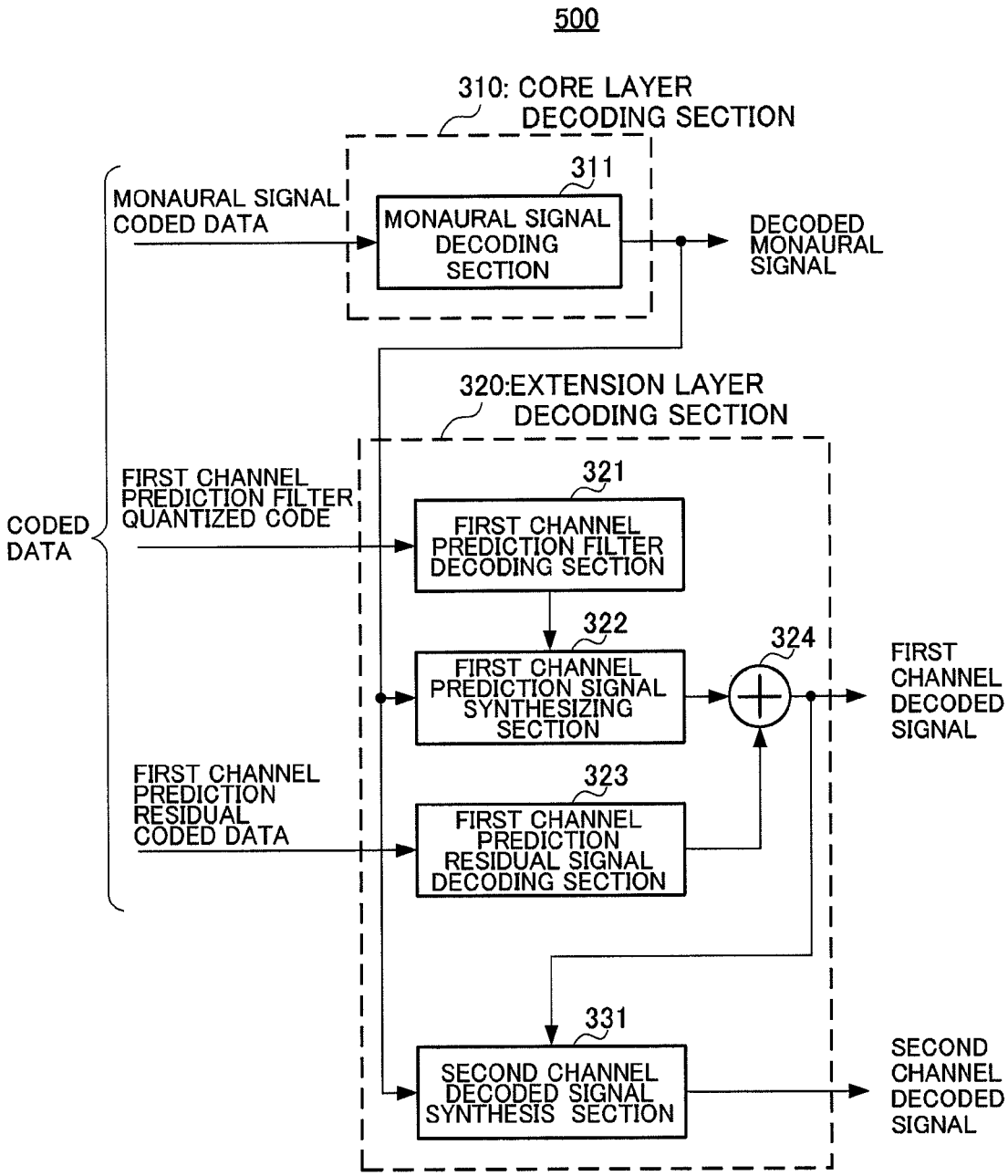
FIG. 8 is a block diagram showing a configuration of the speech decoding apparatus according to Embodiment 2 of the present invention.

On the other hand, FIG. 8 shows a configuration of speech decoding apparatus 500 according to the present embodiment. As shown in FIG. 8, speech decoding apparatus 500 employs a configuration that removes second channel prediction filter decoding section 325, second channel prediction signal synthesizing section 326, second channel prediction residual signal decoding section 327 and adder 328 from the configuration shown in FIG. 4 (Embodiment 1), and adds second channel decoded signal synthesis section 331 instead.

Second channel decoded signal synthesizing section 331 synthesizes a second channel decoded signal sd_ch2($n$) using the decoded monaural signal sd_mono(n) and the first channel decoded signal sd_ch1($n$) based on the relationship represented by equation 1, in accordance with equation 5.

[5]

$$sd_ch2(n)=2\cdot sd_mono(n)-sd_ch1(n) \quad \text{(Equation 5)}$$

Although a case has been described with the present embodiment where extension layer coding section 120 employs a configuration for processing only the first channel, it is possible to provide a configuration for processing only the second channel in place of the first channel.

According to this embodiment, it is possible to provide a more simple configuration of the apparatus than Embodiment 1. Further, coded data for one of the first and second channel is only transmitted so that it is possible to improve coding efficiency.

Embodiment 3

Figure 9:
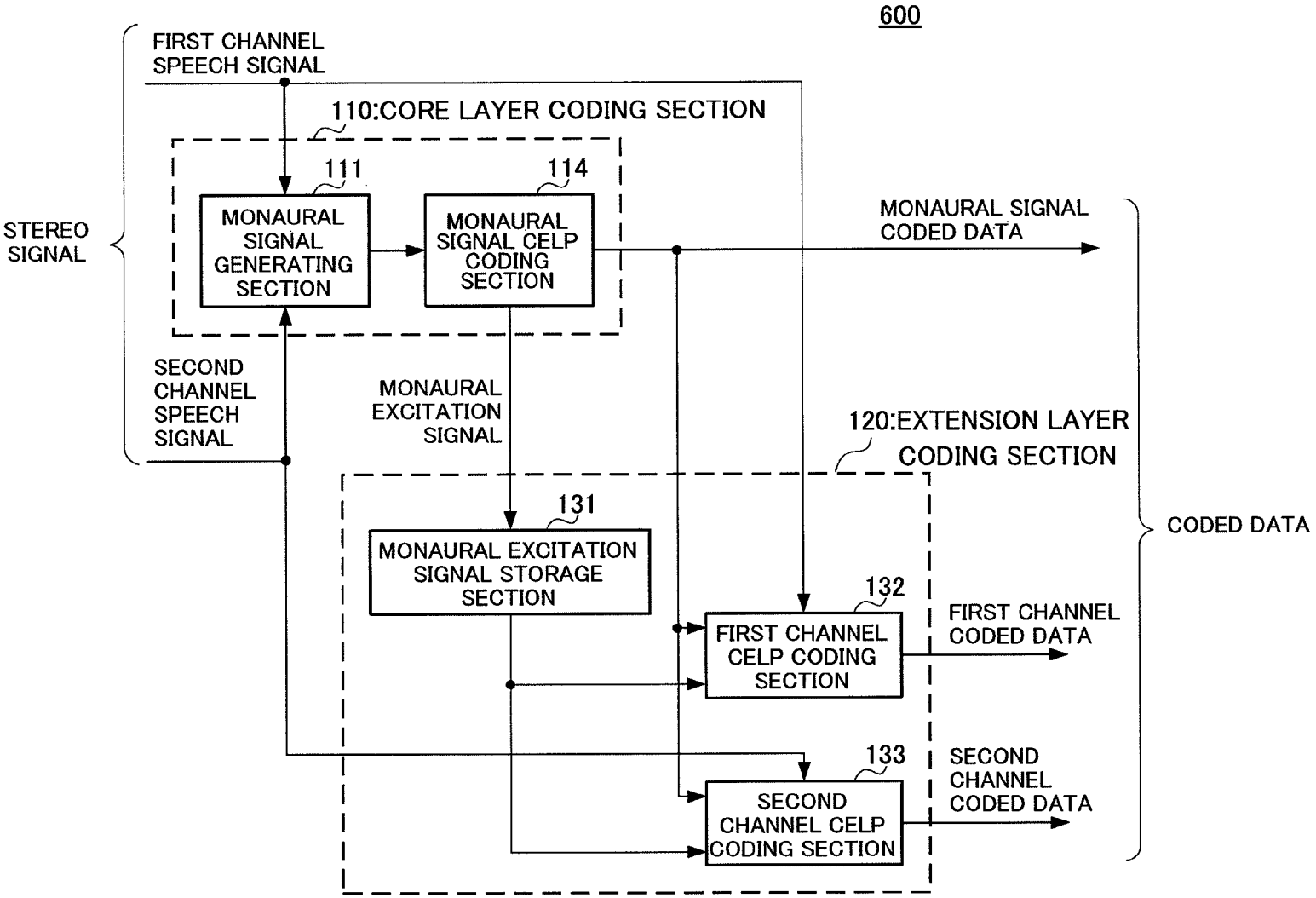
FIG. 9 is a block diagram showing a configuration of a speech coding apparatus according to Embodiment 3 of the present invention.

FIG. 9 shows a configuration of speech coding apparatus 600 according to the present embodiment. Core layer coding section 110 has monaural signal generating section 111 and monaural signal CELP coding section 114, and extension layer coding section 120 has monaural excitation signal storage section 131, first channel CELP coding section 132 and second channel CELP coding section 133.

Monaural signal CELP coding section 114 subjects the monaural signal s_mono(n) generated in monaural signal generating section 111 to CELP coding, and outputs monaural signal coded data and a monaural excitation signal obtained by CELP coding. This monaural excitation signal is stored in monaural excitation signal storage section 131.

First channel CELP coding section 132 subjects the first channel speech signal to CELP coding and outputs first channel coded data. Further, second channel CELP coding section 133 subjects the second channel speech signal to CELP coding and outputs second channel coded data. First channel CELP coding section 132 and second channel CELP coding section 133 predicts excitation signals corresponding to input speech signals of each channel using the monaural excitation signals stored in monaural excitation signal storage section 131, and subject the prediction residual components to CELP coding.

Figure 10:
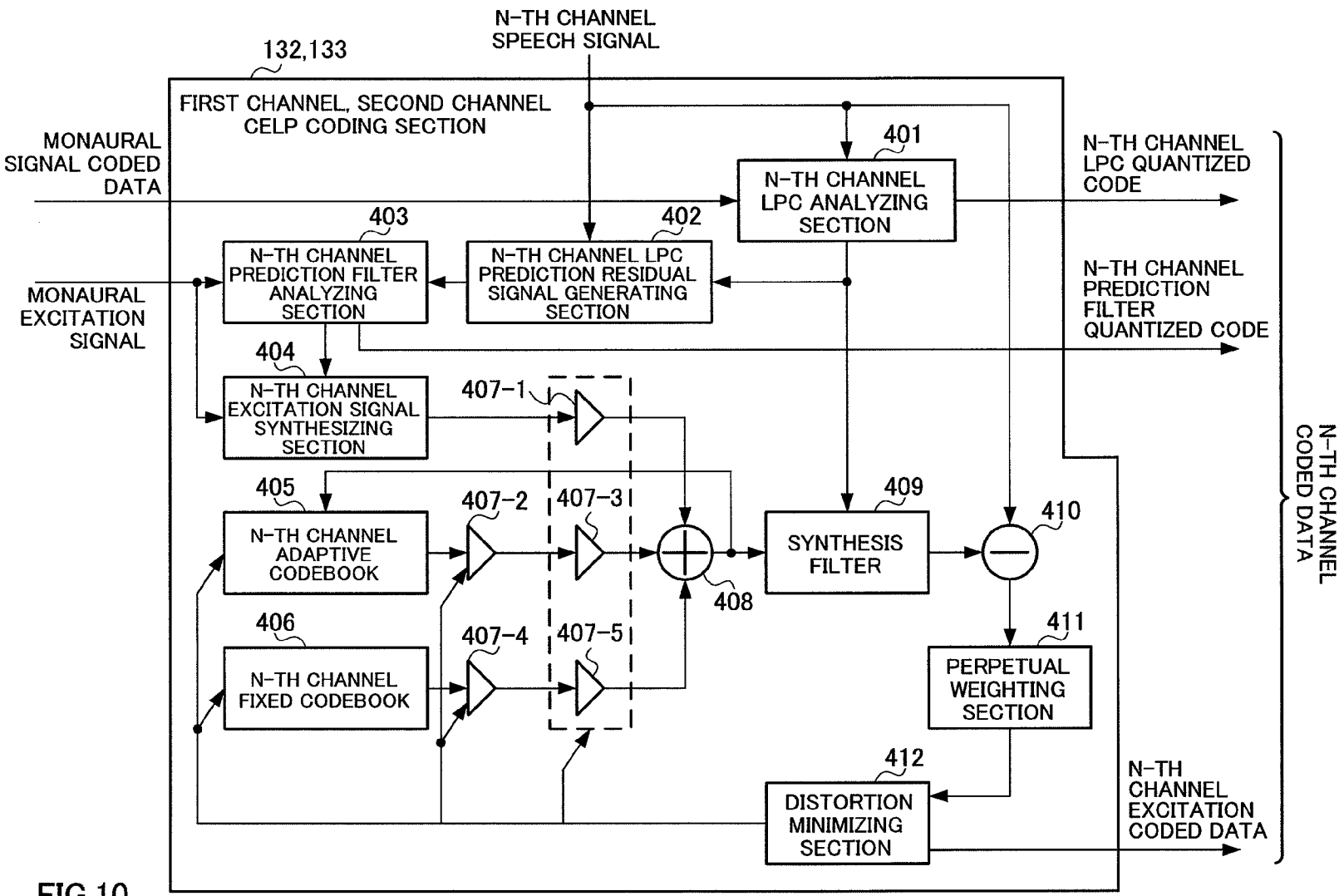
FIG. 10 is a block diagram showing a configuration of first channel and second channel CELP coding sections according to Embodiment 3 of the present invention.

Next, first channel CELP coding section 132 and second channel CELP coding section 133 will be described in detail. FIG. 10 shows a configuration of first channel CELP coding section 132 and second channel CELP coding section 133.

In FIG. 10, N-th channel (where N is 1 or 2) LPC analyzing section 401 subjects an N-th channel speech signal to LPC analysis, quantizes the obtained LPC parameters, outputs the quantized LPC parameters to N-th channel LPC prediction residual signal generating section 402 and synthesis filter 409 and outputs N-th channel LPC quantized code. Upon quantization of LPC parameters, N-th channel LPC analyzing section 401 utilizes the fact that correlation between LPC parameters for the monaural signal and LPC parameters obtained from the N-th channel speech signal (N-th channel LPC parameters) is high, decodes monaural signal quantized LPC parameters from coded data for the monaural signal and quantizes differential components of the N-th channel LPC parameters from the monaural signal quantized LPC parameters, thereby enabling more efficient quantization.

N-th channel LPC prediction residual signal generating section 402 calculates and outputs an LPC prediction residual signal for the N-th channel speech signal to N-th channel prediction filter analyzing section 403 using N-th channel quantized LPC parameters.

N-th channel prediction filter analyzing section 403 obtains and quantizes N-th channel prediction filter parameters from the LPC prediction residual signal and the monaural excitation signal, outputs N-th channel prediction filter quantized parameters to N-th channel excitation signal synthesizing section 404 and outputs N-th channel prediction filter quantized code.

N-th channel excitation signal synthesizing section 404 synthesizes and outputs prediction excitation signals corresponding to N-th channel speech signals to multiplier 407-1 using monaural excitation signals and N-th channel prediction filter quantized parameters.

Here, N-th channel prediction filter analyzing section 403 corresponds to first channel prediction filter analyzing section 121 and second channel prediction filter analyzing section 125 in Embodiment 1 (FIG. 1) and employs the same configuration and operation. Further, N-th channel excitation signal synthesizing section 404 corresponds to first channel prediction signal synthesizing section 122 and second channel prediction signal synthesizing section 126 in Embodiment 1 (FIG. 1 to FIG. 3) and employs the same configuration and operation. However, the present embodiment is different from embodiment 1 in predicting a monaural excitation signal corresponding to the monaural signal and synthesizing the prediction excitation signal of each channel, rather than carrying out prediction with a monaural decoded signal and synthesizing the prediction signal of each channel. The present embodiment encodes excitation signals for residual components (prediction error components) for the prediction excitation signals using excitation search in CELP coding.

Namely, first channel and second channel CELP coding sections 132 and 133 have N-th channel adaptive codebook 405 and N-th channel fixed codebook 406, multiply and add excitation signals which consist of the adaptive excitation signal, fixed excitation signal and the prediction excitation signal predicted from monaural excitation signals with gains of each excitation signal, and subject an excitation signal obtained by this addition to closed loop excitation search which based on distortion minimization. The adaptive excitation index, fixed excitation index, and gain codes for adaptive excitation signal, fixed excitation signal and prediction excitation signal are outputted as N-th channel excitation coded data. To be more specific, this is as follows.

Synthesis filter 409 performs a synthesis through a LPC synthesis filter, using quantized LPC parameters outputted from N-th channel LPC analyzing section 401 and excitation vectors generated in N-th channel adaptive codebook 405 and N-th channel fixed codebook 406, and prediction excitation signal synthesized in N-th channel excitation signal synthesizing section 404 as excitation signals. The components corresponding to the N-th channel prediction excitation signal out of a resulting synthesized signal corresponds to prediction signal of each channel outputted from first channel prediction signal synthesizing section 122 or second channel prediction signal synthesizing section 126 in Embodiment 1 (FIG. 1 to FIG. 3). Further, thus obtained synthesized signal is then outputted to subtractor 410.

Subtractor 410 calculates a difference signal by subtracting the synthesized signal outputted from synthesis filter 409 from the N-th channel speech signal, and outputs the difference signal to perpetual weighting section 411. This difference signal corresponds to coding distortion.

Perceptual weighting section 411 subjects coding distortion outputted from subtractor 410 to perpetual weighting and outputs the result to distortion minimizing section 412.

Distortion minimizing section 412 determines indexes for N-th channel adaptive codebook 405 and N-th channel fixed codebook 406 that minimize coding distortion outputted from perpetual weighting section 411, and instructs indexes used by N-th channel adaptive codebook 405 and N-th channel fixed codebook 406. Further, distortion minimizing section 412 generates gains corresponding to these indexes (to be more specific, gains (adaptive codebook gain and fixed codebook gain) for an adaptive vector from N-th channel adaptive codebook 405 and a fixed vector from N-th channel fixed codebook 406), and outputs the generated gains to multipliers 407-2 and 407-4.

Further, distortion minimizing section 412 generates gains for adjusting gains between the three types of signals, that is, a prediction excitation signal outputted from N-th channel excitation signal synthesizing section 404, an gain-multiplied adaptive vector in multiplier 407-2 and a gain-multiplied fixed vector in multiplier 407-4, and outputs the generated gains to multipliers 407-1, 407-3 and 407-5. The three types of gains for adjusting gain between these three types of signals are preferably generated to include correlation between these gain values. For example, when inter-channel correlation between the first channel speech signal and the second channel speech signal is high, the contribution by the prediction excitation signal is comparatively larger than the contribution by the gain-multiplied adaptive vector and the gain-multiplied fixed vector, and when channel correlation is low, the contribution by the prediction excitation signal is relatively smaller than the contribution by the gain-multiplied adaptive vector and the gain-multiplied fixed vector.

Further, distortion minimizing section 412 outputs these indexes, code of gains corresponding to these indexes and code for the signal-adjusting gains as N-th channel excitation coded data.

N-th channel adaptive codebook 405 stores excitation vectors for an excitation signal previously generated for synthesis filter 409 in an internal buffer, generates one subframe of excitation vector from the stored excitation vectors based on adaptive codebook lag (pitch lag or pitch period) corresponding to the index instructed by distortion minimizing section 412 and outputs the generated vector as an adaptive codebook vector to multiplier 407-2.

N-th channel fixed codebook 406 outputs an excitation vector corresponding to an index instructed by distortion minimizing section 412 to multiplier 407-4 as a fixed codebook vector.

Multiplier 407-2 multiplies an adaptive codebook vector outputted from N-th channel adaptive codebook 405 with an adaptive codebook gain and outputs the result to multiplier 407-3.

Multiplier 407-4 multiplies the fixed codebook vector outputted from N-th channel fixed codebook 406 with a fixed codebook gain and outputs the result to multiplier 407-5.

Multiplier 407-1 multiplies a prediction excitation signal outputted from N-th channel excitation signal synthesizing section 404 with a gain and outputs the result to adder 408. Multiplier 407-3 multiplies the gain-multiplied adaptive vector in multiplier 407-2 with another gain and outputs the result to adder 408. Multiplier 407-5 multiplies the gain-multiplied fixed vector in multiplier 407-4 with another gain and outputs the result to adder 408.

Adder 408 adds the prediction excitation signal outputted from multiplier 407-1, the adaptive codebook vector outputted from multiplier 407-3 and the fixed codebook vector outputted from multiplier 407-5, and outputs an added excitation vector to synthesis filter 409 as an excitation signal.

Synthesis filter 409 performs a synthesis, through the LPC synthesis filter, using an excitation vector outputted from adder 408 as an excitation signal.

Thus, a series of the process of obtaining coding distortion using the excitation vector generated in N-th channel adaptive codebook 405 and N-th channel fixed codebook 406 is a closed loop so that distortion minimizing section 412 determines and outputs indexes for N-th channel adaptive codebook 405 and N-th channel fixed codebook 406 that minimize coding distortion.

First channel and second channel CELP coding sections 132 and 133 outputs thus obtained coded data (LPC quantized code, prediction filter quantized code, excitation coded data) as N-th channel coded data.

Figure 11:
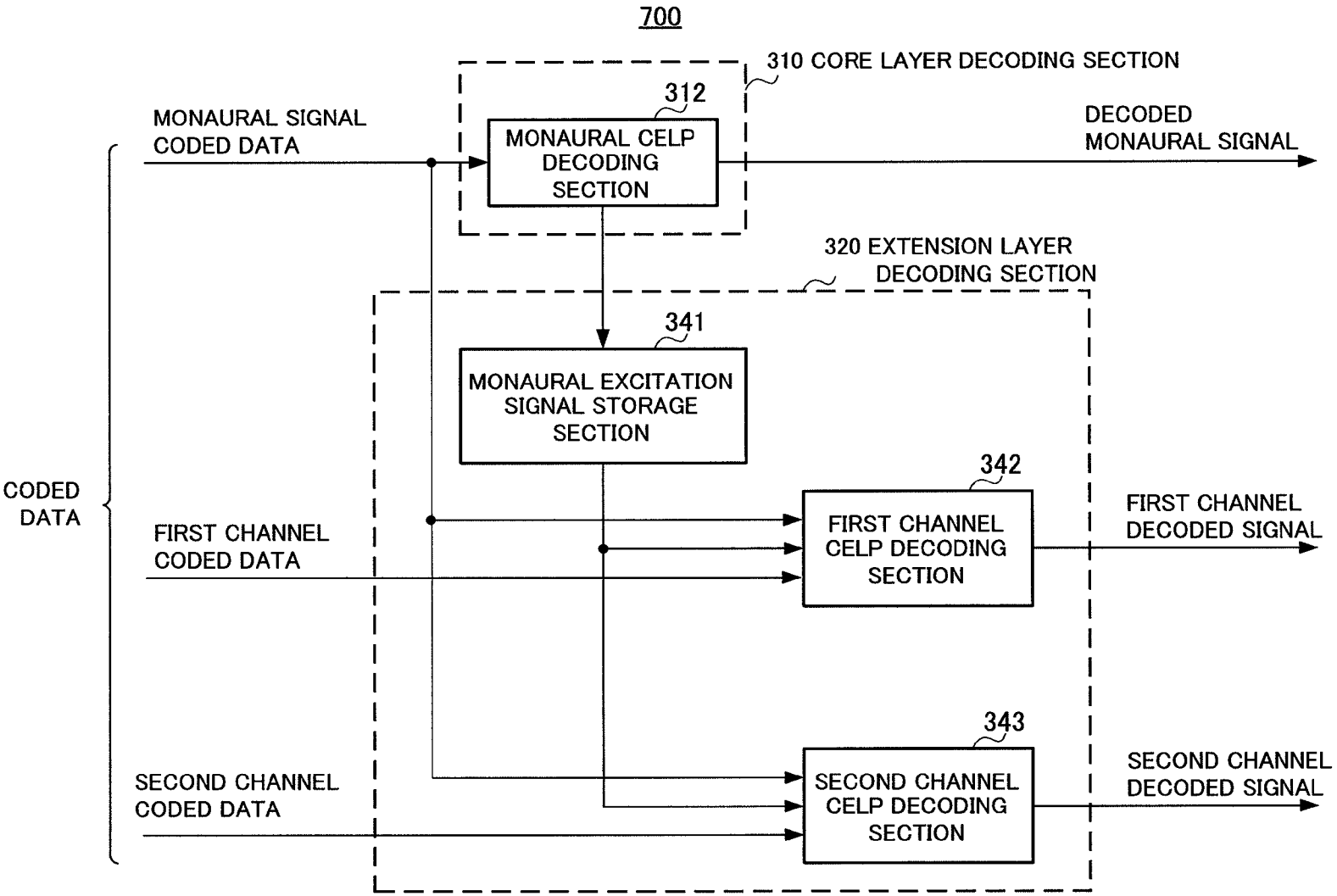
FIG. 11 is a block diagram showing a configuration of the speech coding apparatus according to Embodiment 3 of the present invention.

The speech decoding apparatus according to the present embodiment will be described. FIG. 11 shows configuration of speech decoding apparatus 700 according to the present embodiment. Speech decoding apparatus 700 shown in FIG. 11 has core layer decoding section 310 for the monaural signal and extension layer decoding section 320 for the stereo signal.

Monaural CELP decoding section 312 subjects coded data for the input monaural signal to CELP decoding, and outputs a decoded monaural signal and a monaural excitation signal obtained using CELP decoding. This monaural excitation signal is stored in monaural excitation signal storage section 341.

First channel CELP decoding section 342 subjects first channel coded data to CELP decoding and outputs a first channel decoded signal. Further, second channel CELP decoding section 343 subjects second channel coded data to CELP decoding and outputs a second channel decoded signal. First channel CELP decoding section 342 and second channel CELP decoding section 343 predicts excitation signals corresponding to coded data for each channel and subjects the prediction residual components to CELP decoding using the monaural excitation signals stored in monaural excitation signal storage section 341.

Speech decoding apparatus 700 employing the above configuration, in a monaural-stereo scalable configuration, outputs a decoded signal obtained only from coded data for the monaural signal as a decoded monaural signal when monaural speech is outputted, and decodes and outputs the first channel decoded signal and the second channel decoded signal using all of received coded data when stereo speech is outputted.

Figure 12:
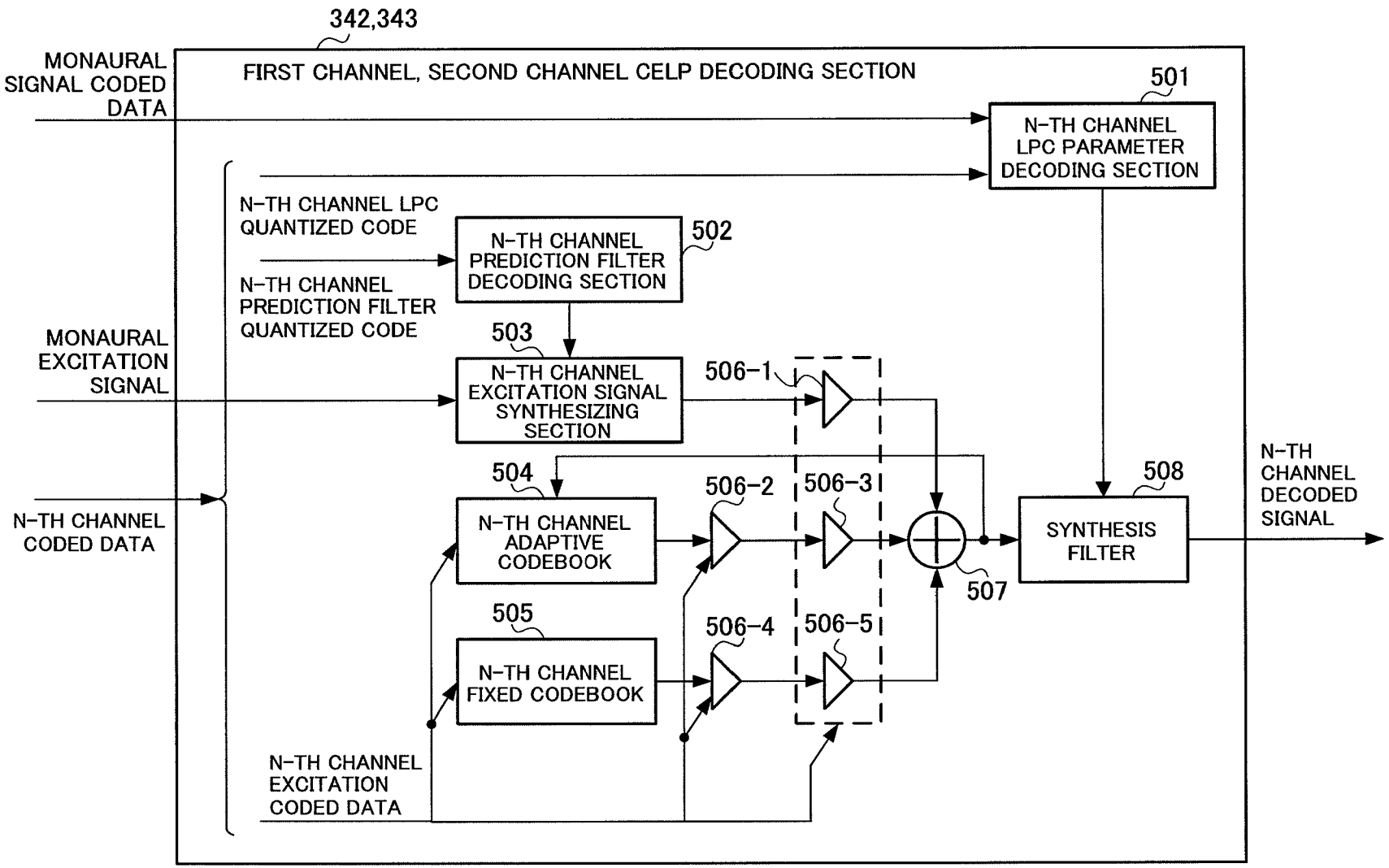
FIG. 12 is a block diagram showing a configuration of first channel and second channel CELP decoding sections according to Embodiment 3 of the present invention.

Next, first channel CELP decoding section 342 and second channel CELP decoding section 343 will be described in detail. FIG. 12 shows a configuration for first channel CELP decoding section 342 and second channel CELP decoding section 343. First channel and second channel CELP decoding sections 342 and 343 decode N-th channel LPC quantized parameters and a CELP excitation signal including a prediction signal of the N-th channel excitation signal, from monaural signal coded data and N-th channel coded data (where N is 1 or 2) transmitted from speech coding apparatus 600 (FIG. 9), and output decoded N-th channel signal. To be more specific, this is as follows.

N-th channel LPC parameter decoding section 501 decodes N-th channel LPC quantized parameters using monaural signal quantized LPC parameters decoded using monaural signal coded data and N-th channel LPC quantized code, and outputs the obtained quantized LPC parameters to synthesis filter 508.

N-th channel prediction filter decoding section 502 decodes N-th channel prediction filter quantized code and outputs the obtained N-th channel prediction filter quantized parameters to N-th channel excitation signal synthesizing section 503.

N-th channel excitation signal synthesizing section 503 synthesizes and outputs a prediction excitation signal corresponding to an N-th channel speech signal to multiplier 506-1 using the monaural excitation signal and N-th channel prediction filter quantized parameters.

Synthesis filter 508 performs a synthesis, through the LPC synthesis filter, using quantized LPC parameters outputted from N-th channel LPC parameter decoding section 501, and using the excitation vectors generated in N-th channel adaptive codebook 504 and N-th channel fixed codebook 505 and the prediction excitation signal synthesized in N-th channel excitation signal synthesizing section 503 as excitation signals. The obtained synthesized signal is then outputted as an N-th channel decoded signal.

N-th channel adaptive codebook 504 stores excitation vector for an excitation signal previously generated for synthesis filter 508 in an internal buffer, generates one subframe of the stored excitation vectors based on adaptive codebook lag (pitch lag or pitch period) corresponding to an index included in N-th channel excitation coded data and outputs the generated vector as the adaptive codebook vector to multiplier 506-2.

N-th channel fixed codebook 505 outputs an excitation vector corresponding to the index included in the N-th channel excitation coded data to multiplier 506-4 as a fixed codebook vector.

Multiplier 506-2 multiplies the adaptive codebook vector outputted from N-th channel adaptive codebook 504 with an adaptive codebook gain included in N-th channel excitation coded data and outputs the result to multiplier 506-3.

Multiplier 506-4 multiplies the fixed codebook vector outputted from N-th channel fixed codebook 505 with a fixed codebook gain included in N-th channel excitation coded data, and outputs the result to multiplier 506-5.

Multiplier 506-1 multiplies the prediction excitation signal outputted from N-th channel excitation signal synthesizing section 503 with an adjusting gain for the prediction excitation signal included in N-th channel excitation coded data, and outputs the result to adder 507.

Multiplier 506-3 multiplies the gain-multiplied adaptive vector by multiplier 506-2 with an adjusting gain for an adaptive vector included in N-th channel excitation coded data, and outputs the result to adder 507.

Multiplier 506-5 multiplies the gain-multiplied fixed vector by multiplier 506-4 with an adjusting gain for a fixed vector included in N-th channel excitation coded data, and outputs the result to adder 507.

Adder 507 adds the prediction excitation signal outputted from multiplier 506-1, the adaptive codebook vector outputted from multiplier 506-3 and the fixed codebook vector outputted from multiplier 506-5, and outputs an added excitation vector, to synthesis filter 508 as an excitation signal.

Synthesis filter 508 performs a synthesis, through the LPC synthesis filter, using the excitation vector outputted from adder 507 as an excitation signal.

Figure 13:
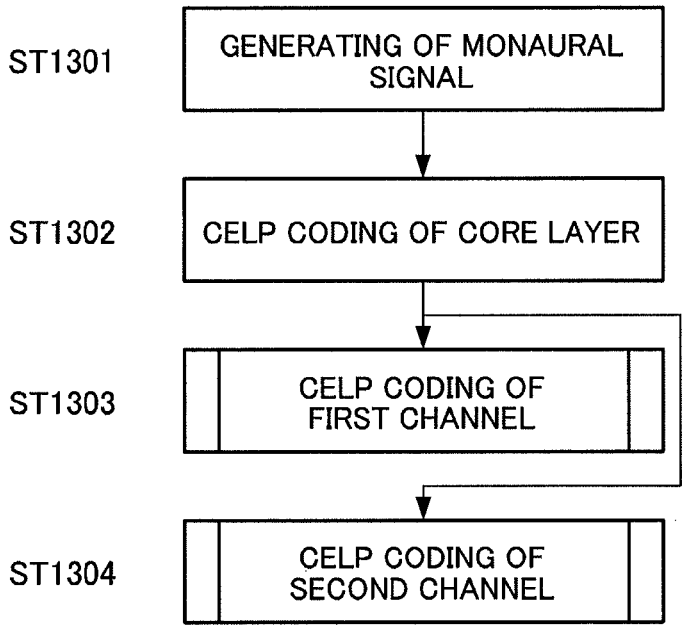
FIG. 13 is a flow chart illustrating the operation of a speech coding apparatus according to Embodiment 3 of the present invention.

FIG. 13 shows the above operation flow of speech coding apparatus 600. Namely, the monaural signal is generated from the first channel speech signal and the second channel speech signal (ST1301), and the monaural signal is subjected to CELP coding at core layer (ST1302) and then subjected to first channel CELP coding and second channel CELP coding (ST1303, 1304).

Figure 14:
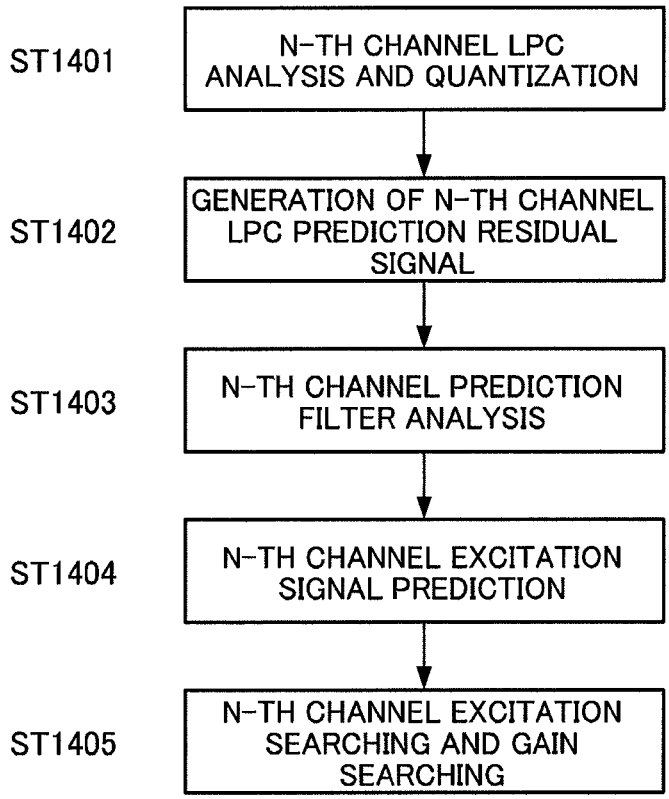
FIG. 14 is a flow chart illustrating the operation of first channel and second channel CELP coding sections according Embodiment 3 of the present invention.

Further, FIG. 14 shows the operation flow of first channel and second channel CELP coding sections 132 and 133. Namely, first, N-th channel LPC is analyzed, N-th LPC parameters are quantized (ST1401), and anN-th channel LPC prediction residual signal is generated (ST1402). Next, N-th channel prediction filter is analyzed (ST1403) and an N-th channel excitation signal is predicted (ST1404). Finally, N-th channel excitation is searched and an N-th channel gain is searched (ST1405).

Although first channel and second channel CELP coding sections 132 and 133 obtain prediction filter parameters by N-th channel prediction filter analyzing section 403 prior to excitation coding using excitation search in CELP coding, first channel and second channel CELP coding sections 132 and 133 may employ a configuration providing a codebook for prediction filter parameters, and perform, in CELP excitation search, a closed loop search with other excitation searches like adaptive excitation search using distortion minimization and obtain optimum prediction filter parameters based on that codebook. Further, N-th channel prediction filter analyzing section 403 may employ a configuration for obtaining a plurality of candidates for prediction filter parameters, and selecting optimum prediction filter parameters from this plurality of candidates by closed loop search using minimizing distortion in CELP excitation search. By adopting the above configuration, it is possible to calculate more optimum filter parameters and improve prediction performance, that is, improve decoded speech quality.

Further, although excitation coding using excitation search in CELP coding in first channel and second channel CELP coding sections 132 and 133 employs a configuration for multiplying gains for three types of signal-adjusting gains with three types of signals that is, a prediction excitation signal corresponding to the N-th channel excitation signal, an gain-multiplied adaptive vector and a gain-multiplied fixed vector, excitation coding may employ a configuration for not using such adjusting gains or a configuration for multiplying the prediction signal corresponding to the N-th channel speech signal with a gain as an adjusting gain.

Further, excitation coding may employ a configuration of utilizing monaural signal coded data obtained by CELP coding of the monaural signal at the time of CELP excitation search and encoding the differential component (correction component) for monaural signal coded data. For example, when coding adaptive excitation lag and excitation gains, a differential value from the adaptive excitation lag and relative ratio to an adaptive excitation gain and a fixed excitation gain obtained in CELP coding of the monaural signal are subjected to encoding. As a result, it is possible to improve coding efficiency for CELP excitation signals of each channel.

Further, a configuration of extension layer coding section 120 of speech coding apparatus 600 (FIG. 9) may relate only to the first channel as in Embodiment 2 (FIG. 7). Namely, extension layer coding section 120 predicts the excitation signal using the monaural excitation signal with respect to the first channel speech signal alone and subjects the prediction differential components to CELP coding. In this case, to decode the second channel signal as in Embodiment 2 (FIG. 8), extension layer decoding section 320 of speech decoding apparatus 700 (FIG. 11), synthesizes the second channel decoded signal sd_ch2(*n*) in accordance with equation 5 based on the relationship represented by equation 1 using the decoded monaural signal sd_mono(n) and the first channel decoded signal sd_ch1(*n*).

Further, first channel and second channel CELP coding sections 132 and 133, and first channel and second channel CELP decoding sections 342 and 343 may employ a configuration of using one of the adaptive excitation signal and the fixed excitation signal as an excitation configuration in excitation search.

Figure 15:
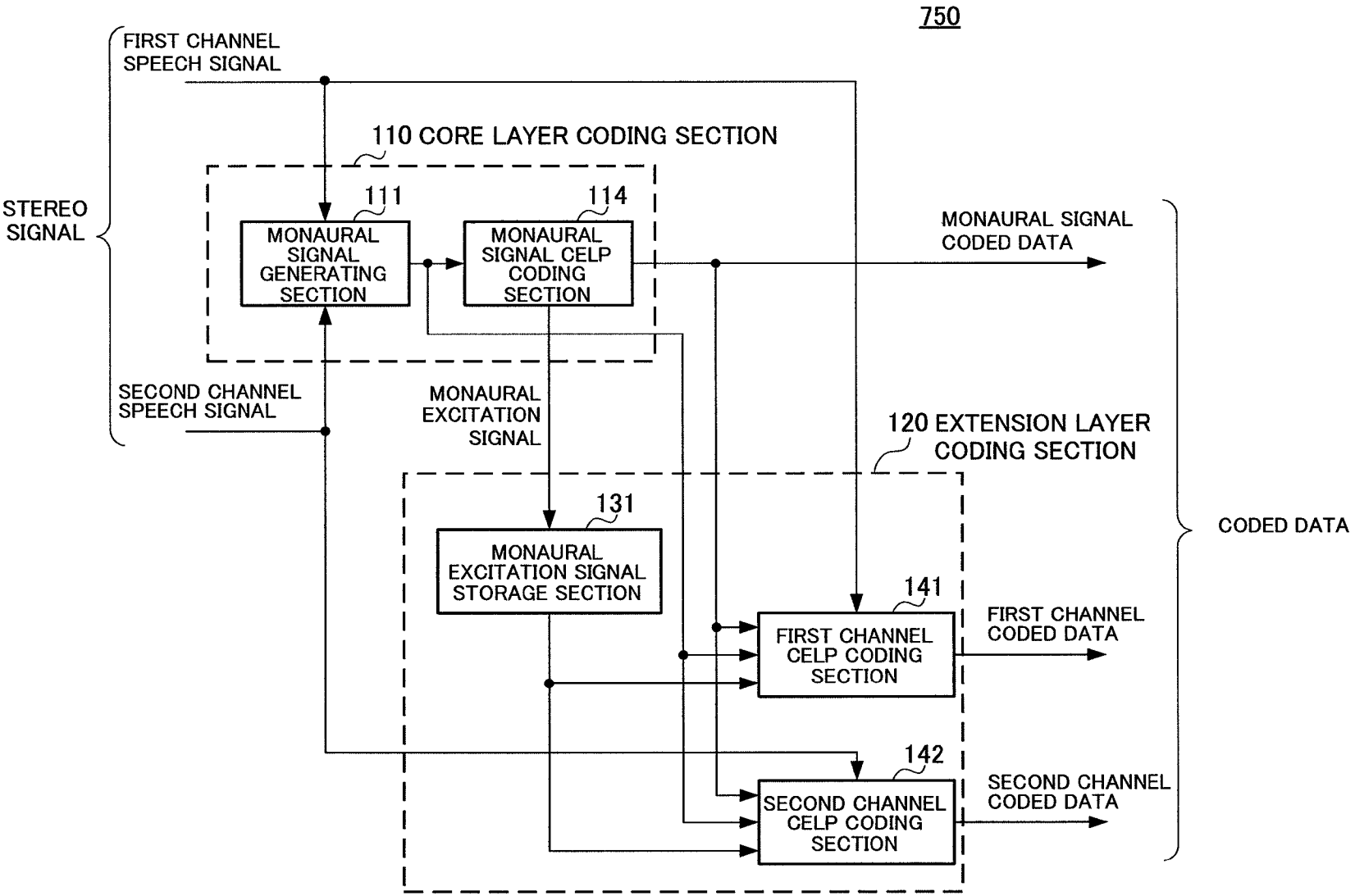
FIG. 15 is a block diagram showing another configuration of a speech coding apparatus according to Embodiment 3 of the present invention.
Figure 16:
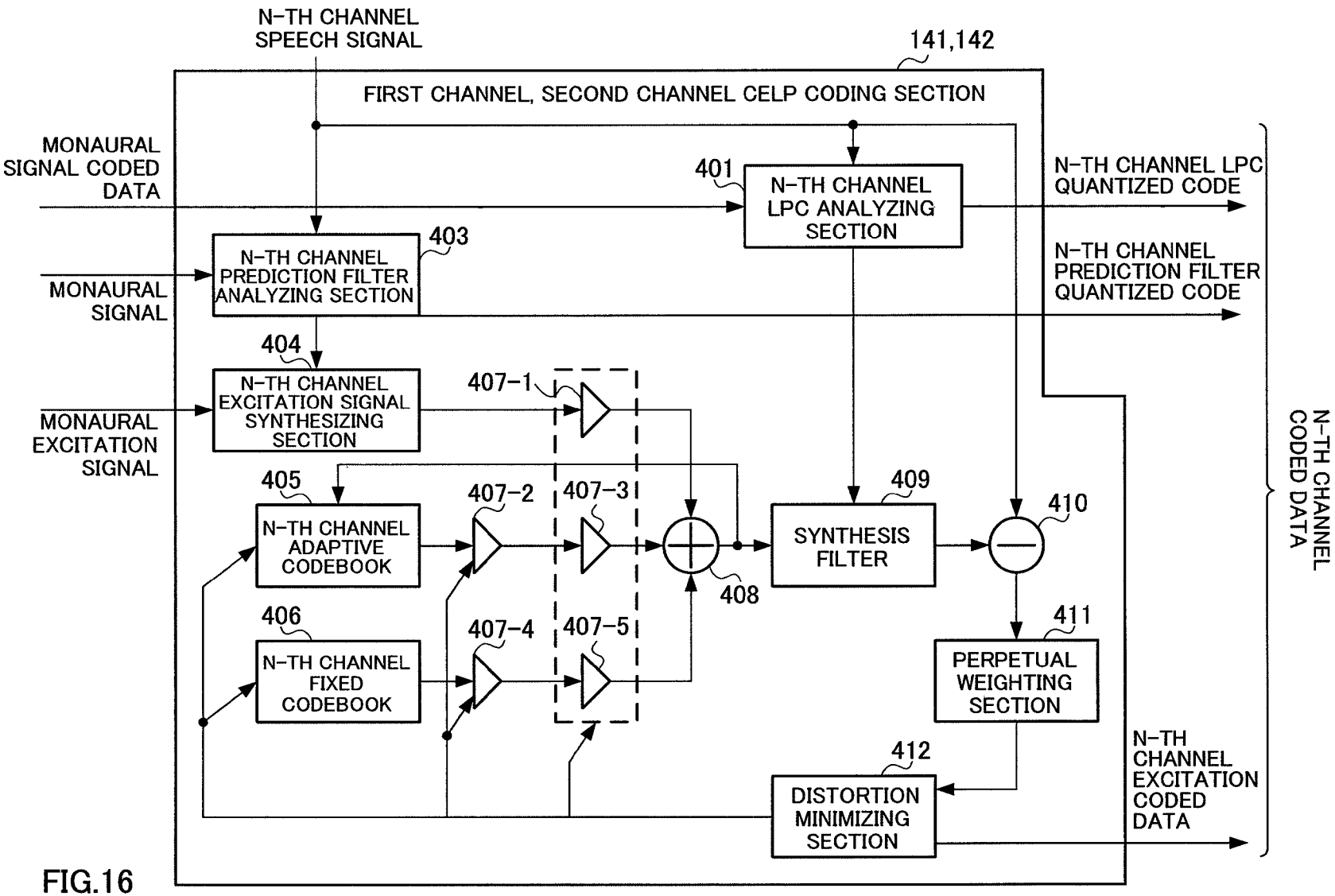
FIG. 16 is a block diagram showing a configuration of first channel and second channel CELP coding sections according to Embodiment 3 of the present invention.

Moreover, N-th channel prediction filter analyzing section 403 may obtain the N-th channel prediction filter parameters using the N-th channel speech signal in place of the LPC prediction residual signal and the monaural signal s_mono(n) generated in monaural signal generating section 111 in place of the monaural excitation signal. FIG. 15 shows a configuration of speech coding apparatus 750 in this case, and FIG. 16 shows a configuration of first channel CELP coding section 141 and second channel CELP coding section 142. As shown in FIG. 15, the monaural signal s_mono (n) generated in monaural signal generating section 111 is inputted to first channel CELP coding section 141 and second channel CELP coding section 142. N-th channel prediction filter analyzing section 403 of first channel CELP coding section 141 and second channel CELP coding section 142 shown in FIG. 16 obtains N-th channel prediction filter parameters using the N-th channel speech signal and the monaural signal s_mono (n) As a result of this configuration, it is not necessity to calculate the LPC prediction residual signal from the N-th channel speech signal using N-th channel quantized LPC parameters. Further, it is possible to obtain N-th channel prediction filter parameters by using the monaural signal s_mono(n) in place of the monaural excitation signal. In this case, a future signal can be used compared to a case where the monaural excitation signal is used. N-th channel prediction filter analyzing section 403 may use the decoded monaural signal obtained by encoding in monaural signal CELP coding section 114 rather than using the monaural signal s_mono (n) generated in monaural signal generating section 111.

Further, the internal buffer of N-th channel adaptive codebook 405 may store a signal vector obtained by adding only the gain-multiplied adaptive vector in multiplier 407-3 and the gain-multiplied fixed vector in multiplier 407-5 in place of the excitation vector of the excitation signal to synthesis filter 409. In this case, the N-th channel adaptive codebook on the decoding side requires the same configuration.

Further, in encoding the excitation signals of the residual components for the prediction excitation signals of each channel in first channel and second channel CELP coding sections 132 and 133, the excitation signals of the residual components may be converted in the frequency domain and the excitation signals of the residual components may be encoded in the frequency domain rather than excitation search in the time domain using CELP coding.

The present embodiment uses CELP coding appropriate for speech coding so that it is possible to perform more efficient coding.

Embodiment 4

Figure 17:
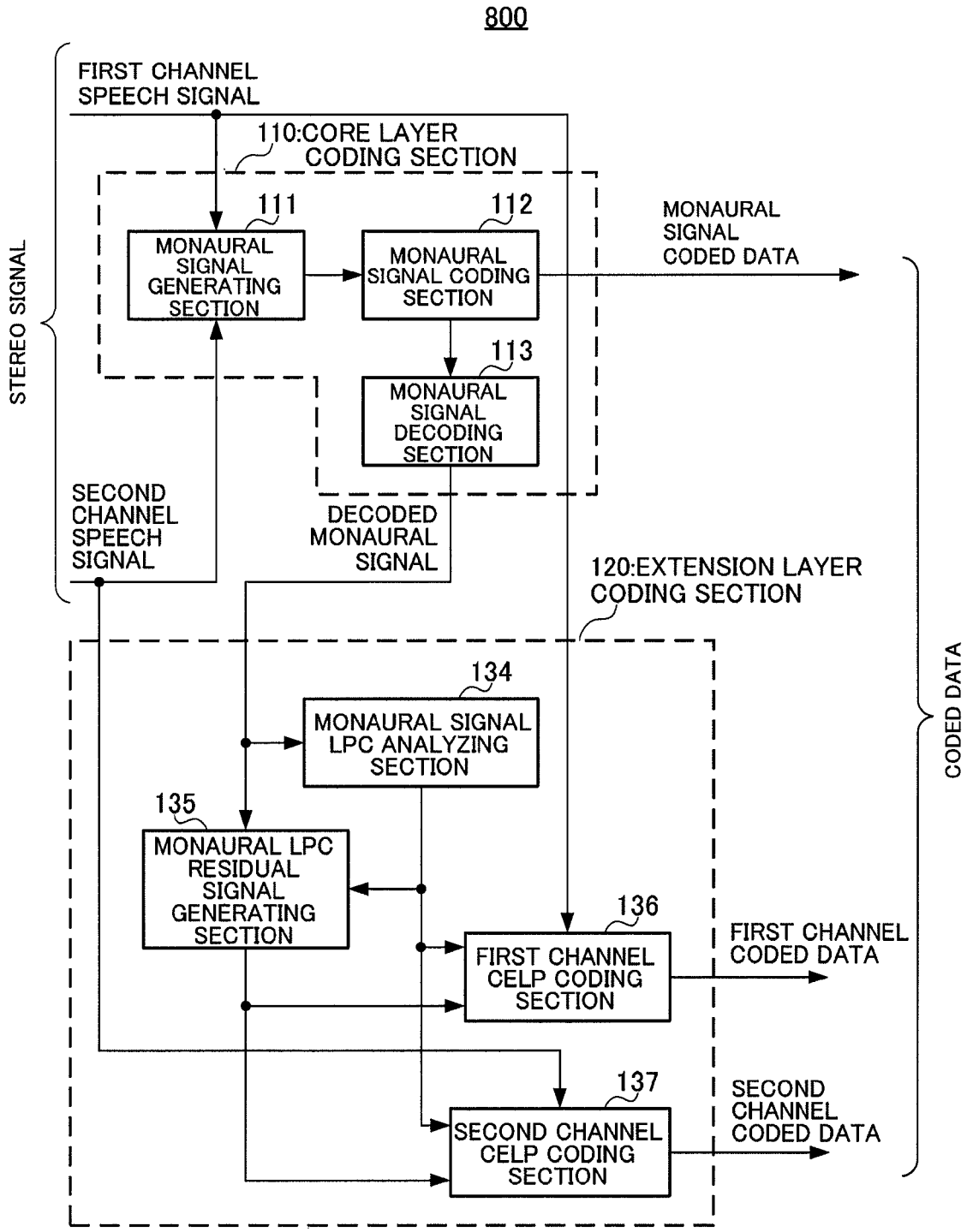
FIG. 17 is a block diagram showing a configuration of a speech coding apparatus according to Embodiment 4 of the present invention.

FIG. 17 shows a configuration for speech coding apparatus 800 according to the present embodiment. Speech coding apparatus 800 has core layer coding section 110 and extension layer coding section 120. The configuration of core layer coding section 110 is the same as Embodiment 1 (FIG. 1) and is therefore not described.

Extension layer coding section 120 has monaural signal LPC analyzing section 134, monaural LPC residual signal generating section 135, first channel CELP coding section 136 and second channel CELP coding section 137.

Monaural signal LPC analyzing section 134 calculates LPC parameters for the decoded monaural signal, and outputs the monaural signal LPC parameters to monaural LPC residual signal generating section 135, first channel CELP coding section 136 and second channel CELP coding section 137.

Monaural LPC residual signal generating section 135 generates and outputs an LPC residual signal (monaural LPC residual signal) for the decoded monaural signal using the LPC parameters to first channel CELP coding section 136 and second channel CELP coding section 137.

First channel CELP coding section 136 and second channel CELP coding section 137 subject speech signals of each channel to CELP coding using the LPC parameters and the LPC residual signal for the decoded monaural signal, and output coded data of each channel.

Figure 18:
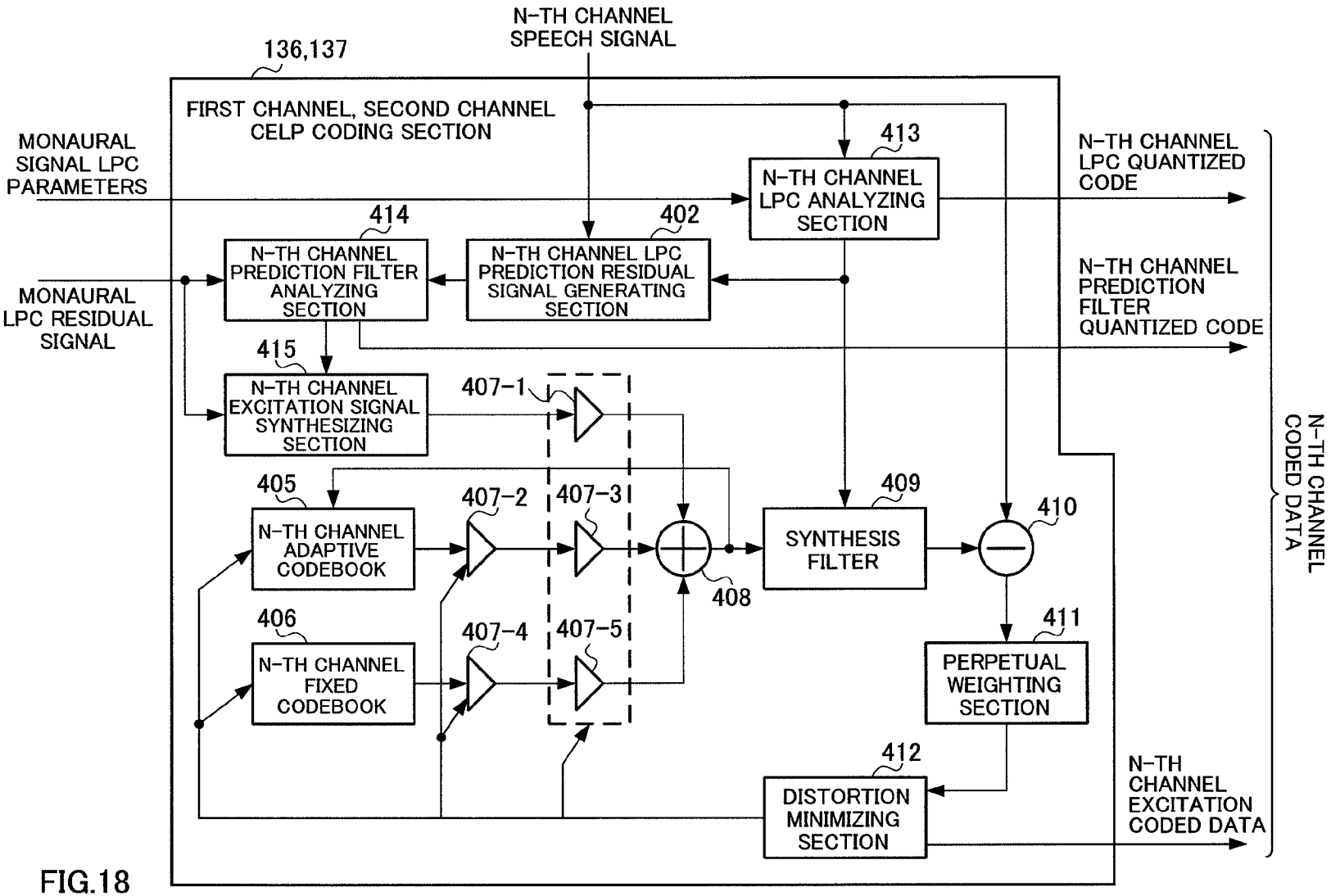
FIG. 18 is a block diagram showing a configuration of a first channel and second channel CELP coding sections according to Embodiment 4 of the present invention.

Next, first channel CELP coding section 136 and second channel CELP coding section 137 will be described in detail. FIG. 18 shows a configuration of first channel CELP coding section 136 and second channel CELP coding section 137. In FIG. 18, the same components as Embodiment 3 are allotted the same reference numerals and are not described.

N-th channel LPC analyzing section 413 subjects an N-th channel speech signal to LPC analysis, quantizes the obtained LPC parameters, outputs the obtained LPC parameters to N-th channel LPC prediction residual signal generating section 402 and synthesis filter 409 and outputs N-th channel LPC quantized code. N-th channel LPC analyzing section 413, when quantizing LPC parameters, performs quantization efficiently by quantizing a differential component for the N-th channel LPC parameters with respect to the monaural signal LPC parameters utilizing the fact that correlation between LPC parameters for the monaural signal and LPC parameters (N-th channel LPC parameters) obtained from the N-th channel speech signal is high.

N-th channel prediction filter analyzing section 414 obtains and quantizes N-th channel prediction filter parameters from an LPC prediction residual signal outputted from N-th channel LPC prediction residual signal generating section 402 and a monaural LPC residual signal outputted from monaural LPC residual signal generating section 135, outputs N-th channel prediction filter quantized parameters to N-th channel excitation signal synthesizing section 415 and outputs N-th channel prediction filter quantized code.

N-th channel excitation signal synthesizing section 415 synthesizes and outputs a prediction excitation signal corresponding to an N-th channel speech signal to multiplier 407-1 using the monaural LPC residual signal and N-th channel prediction filter quantized parameters.

The speech decoding apparatus corresponding to speech coding apparatus 800 employs the same configuration as speech coding apparatus 800, calculates LPC parameters and a LPC residual signal for the decoded monaural signal and uses the result for synthesizing excitation signals of each channel in CELP decoding sections of each channel.

Further, N-th channel prediction filter analyzing section 414 may obtain N-th channel prediction filter parameters using the N-th channel speech signal and the monaural signal s_mono (n) generated in monaural signal generating section 111 instead of using the LPC prediction residual signals outputted from N-th channel LPC prediction residual signal generating section 402 and the monaural LPC residual signal outputted from monaural LPC residual signal generating section 135. Moreover, the decoded monaural signal may be used instead of using the monaural signal s_mono(n) generated in monaural signal generating section 111.

The present embodiment has monaural signal LPC analyzing section 134 and monaural LPC residual signal generating section 135, so that, when monaural signals are encoded using an arbitrary coding scheme at core layers, it is possible to perform CELP coding at extension layers.

The speech coding apparatus and speech decoding apparatus of the above embodiments can also be mounted on wireless communication apparatus such as wireless communication mobile station apparatus and wireless communication base station apparatus used in mobile communication systems.

Also, in the above embodiments, a case has been described as an example where the present invention is configured by hardware. However, the present invention can also be realized by software.

Each function block employed in the description of each of the aforementioned embodiments may typically be implemented as an LSI constituted by an integrated circuit. These may be individual chips or partially or totally contained on a single chip.

"LSI" is adopted here but this may also be referred to as "IC", system LSI", "super LSI", or "ultra LSI" depending on differing extents of integration.

Further, the method of circuit integration is not limited to LSI's, and implementation using dedicated circuitry or general purpose processors is also possible. After LSI manufacture, utilization of an FPGA (Field Programmable Gate Array) or a reconfigurable processor where connections and settings of circuit cells within an LSI can be reconfigured is also possible.

Further, if integrated circuit technology comes out to replace LSI's as a result of the advancement of semiconductor technology or a derivative other technology, it is naturally also possible to carry out function block integration using this technology. Application of biotechnology is also possible.

This specification is based on Japanese patent application No. 2004-377965, filed on Dec. 27, 2004, and Japanese patent application No. 2005-237716, filed on Aug. 18, 2005, the entire content of which is expressly incorporated by reference herein.

INDUSTRIAL APPLICABILITY

The present invention is applicable to uses in the communication apparatus of mobile communication systems and packet communication systems employing internet protocol.

The invention claimed is:

1. A speech coding apparatus, comprising:

a first coding section that encodes a monaural signal at a core layer; and a second coding section that encodes a stereo signal at an extension layer, wherein:

the first coding section comprises a generating section that takes a stereo signal including a first channel signal and a second channel signal as input signals and generates a monaural signal from the first channel signal and the second channel signal; and the second coding section comprises a synthesizing section that synthesizes a prediction signal of one of the first channel signal and the second channel signal based on a signal obtained from the monaural signal, wherein:

the synthesizing section synthesizes the prediction signal using a delay difference and an amplitude ratio of one of the first channel signal and the second channel signal with respect to the monaural signal.

2. A radio communication mobile station apparatus comprising the speech coding apparatus according to claim 1.

3. A radio communication base station apparatus comprising the speech coding apparatus according to claim 1.

4. A speech coding apparatus, comprising:

a first coding section that encodes a monaural signal at a core layer; and a second coding section that encodes a stereo signal at an extension layer, wherein:

the first coding section comprises a generating section that takes a stereo signal including a first channel signal and a second channel signal as input signals and generates a monaural signal from the first channel signal and the second channel signal; and the second coding section comprises a synthesizing section that synthesizes a prediction signal of one of the first channel signal and the second channel signal based on a signal obtained from the monaural signal, wherein:

the second coding section encodes a residual signal between the prediction signal and one of the first channel signal and the second channel signal.

5. A radio communication mobile station apparatus comprising the speech coding apparatus according to claim 4.

6. A radio communication base station apparatus comprising the speech coding apparatus according to claim 4.

7. A speech coding apparatus, comprising:

a first coding section that encodes a monaural signal at a core layer; and a second coding section that encodes a stereo signal at an extension layer, wherein:

the first coding section comprises a generating section that takes a stereo signal including a first channel signal and a second channel signal as input signals and generates a monaural signal from the first channel signal and the second channel signal; and the second coding section comprises a synthesizing section that synthesizes a prediction signal of one of the first channel signal and the second channel signal based on a signal obtained from the monaural signal, wherein:

the synthesizing section synthesizes the prediction signal based on a monaural excitation signal obtained by CELP coding the monaural signal.

8. The speech coding apparatus according to claim 7, wherein:

the second coding section further comprises a calculating section that calculates a first channel LPC residual signal or a second channel LPC residual signal from the first channel signal or the second channel signal; and the synthesizing section synthesizes the prediction signal using a delay difference and an amplitude ratio of one of the first channel LPC residual signal and the second channel LPC residual signal with respect to the monaural excitation signal.

9. The speech coding apparatus according to claim 8, wherein the synthesizing section synthesizes the prediction signal using the delay difference and the amplitude ratio calculated from the monaural excitation signal and one of the first channel LPC residual signal and the second channel LPC residual signal.

10. The speech coding apparatus according to claim 7, wherein the synthesizing section synthesizes the prediction signal using a delay difference and an amplitude ratio of one of the first channel signal and the second channel signal with respect to the monaural signal.

11. The speech coding apparatus according to claim 10, wherein the synthesizing section synthesizes the prediction signal using the delay difference and the amplitude ratio calculated from the monaural signal and one of the first channel signal and the second channel signal.

12. A radio communication mobile station apparatus comprising the speech coding apparatus according to claim 7.

13. A radio communication base station apparatus comprising the speech coding apparatus according to claim 7.

14. A speech coding method for encoding a monaural signal at a core layer and encoding a stereo signal at an extension layer, comprising:

taking a stereo signal including a first channel signal and a second channel signal as input signals and generating a monaural signal from the first channel signal and the second channel signal, at the core layer; and synthesizing a prediction signal of one of the first channel signal and the second channel signal based on a signal obtained from the monaural signal, at the extension layer, wherein:

the synthesizing synthesizes the prediction signal using a delay difference and an amplitude ratio of one of the first channel signal and the second channel signal with respect to the monaural signal.

15. A speech coding method for encoding a monaural signal at a core layer and encoding a stereo signal at an extension layer, comprising:

taking a stereo signal including a first channel signal and a second channel signal as input signals and generating a monaural signal from the first channel signal and the second channel signal, at the core layer; and synthesizing a prediction signal of one of the first channel signal and the second channel signal based on a signal obtained from the monaural signal, at the extension layer, wherein:

the synthesizing encodes a residual signal between the prediction signal and one of the first channel signal and the second channel signal.

16. A speech coding method for encoding a monaural signal at a core layer and encoding a stereo signal at an extension layer, comprising:

taking a stereo signal including a first channel signal and a second channel signal as input signals and generating a monaural signal from the first channel signal and the second channel signal, at the core layer; and synthesizing a prediction signal of one of the first channel signal and the second channel signal based on a signal obtained from the monaural signal, at the extension layer, wherein:

the synthesizing synthesizes the prediction signal based on a monaural excitation signal obtained by CELP coding the monaural signal.

* * * * *